US007203977B2

(12) United States Patent
Mattson, Jr. et al.

(10) Patent No.: US 7,203,977 B2
(45) **Date of Patent: *Apr. 17, 2007**

(54) FILL AND DRAIN JETTED HYDROMASSAGE ANTIMICROBIAL WATER VESSEL

(75) Inventors: Roy W. Mattson, Jr., 1732 Spencer St., Longmont, CO (US) 80501; Paulette C. Ogden, 1732 Spencer St., Longmont, CO (US) 80501; Philip I. Ogden, Longmont, CO (US)

(73) Assignees: Roy W. Mattson, Jr., Longmont, CO (US); Paulette C. Ogden, Longmont, CO (US)

( * ) Notice: Subject to any disclaimer, the term of this patent is extended or adjusted under 35 U.S.C. 154(b) by 0 days.

This patent is subject to a terminal disclaimer.

(21) Appl. No.: 11/212,235

(22) Filed: Aug. 26, 2005

(65) Prior Publication Data

US 2005/0283902 A1 Dec. 29, 2005

Related U.S. Application Data

(60) Continuation of application No. 11/114,844, filed on Apr. 26, 2005, now Pat. No. 6,971,125, which is a continuation of application No. 10/841,925, filed on May 7, 2004, now abandoned, which is a division of application No. 10/211,497, filed on Aug. 2, 2002, now Pat. No. 6,760,931.

(51) Int. Cl.
*A47K 3/00* (2006.01)
*A47K 3/01* (2006.01)

(52) U.S. Cl. ..... 4/541.1; 4/507; 4/509; 210/169

(58) Field of Classification Search ..... 4/490, 4/504, 507, 509, 538, 541.1–541.3, 584; 210/169, 749, 416.2, 755, 764; 137/268; 422/274, 275, 261–264, 281
See application file for complete search history.

(56) References Cited

U.S. PATENT DOCUMENTS

| | | | |
|---|---|---|---|
| 148,288 | A | 3/1874 | Edgar |
| 206,938 | A | 8/1878 | Emory |
| 553,383 | A | 1/1896 | Bailey |
| 828,716 | A | 8/1906 | Craig |
| 1,284,615 | A | 11/1918 | Delely |
| 1,428,618 | A | 9/1922 | Wagner |

(Continued)

FOREIGN PATENT DOCUMENTS

| | | |
|---|---|---|
| DE | 199 61049 | 6/2001 |

(Continued)

OTHER PUBLICATIONS

Antimicrobial Alphasan® RC Products, Milliken Chemical, Aug. 18, 2004.

(Continued)

*Primary Examiner*—Tuan Nguyen
(74) *Attorney, Agent, or Firm*—Benjamin Fernandez

(57) ABSTRACT

A fill and drain hydromassage water vessel having an acrylic surface, resin and fiberglass backing and antimicrobial in components of the water vessel system. The antimicrobial reduces bacteria in the water vessel system.

8 Claims, 23 Drawing Sheets

U.S. PATENT DOCUMENTS

| | | | |
|---|---|---|---|
| 1,594,400 | A | 8/1926 | Wiest |
| 2,073,784 | A | 3/1937 | Day |
| 2,194,056 | A | 3/1940 | Quagk |
| 2,204,898 | A | 6/1940 | Lee |
| 2,247,116 | A | 6/1941 | Day |
| 2,329,987 | A | 9/1943 | Goodloe |
| 2,367,794 | A | 1/1945 | Marselus |
| 2,552,709 | A | 5/1951 | Clements |
| 2,709,489 | A | 5/1955 | Keebler |
| 3,027,391 | A | 3/1962 | Selri |
| 3,198,726 | A | 8/1965 | Triklis |
| 3,263,811 | A | 8/1966 | Bakes et al. |
| 3,294,680 | A | 12/1966 | Lancy |
| 3,385,445 | A | 5/1968 | Bochegger et al. |
| 3,422,183 | A | 1/1969 | Ellison |
| 3,426,901 | A | 2/1969 | Sherper |
| 3,575,853 | A | 4/1971 | Gaughan |
| 3,615,294 | A | 10/1971 | Long |
| 3,697,567 | A | 10/1972 | Taylor, Jr. |
| 3,702,298 | A | 11/1972 | Solaos, Jr. et al. |
| 3,766,036 | A | 10/1973 | McKartney |
| 3,788,982 | A | 1/1974 | Soldos |
| 3,802,910 | A | 4/1974 | Geron |
| 3,839,202 | A | 10/1974 | Roy |
| 3,857,704 | A | 12/1974 | Coulter |
| 3,873,581 | A | 3/1975 | Fitzpatrick |
| 3,905,827 | A | 9/1975 | Goffredo |
| 3,922,224 | A | 11/1975 | Lewandowski |
| 3,933,635 | A | 1/1976 | Marchant |
| 3,976,571 | A | 8/1976 | Rio |
| 3,989,623 | A | 11/1976 | Neal |
| 4,005,011 | A | 1/1977 | Sweeny |
| 4,026,797 | A | 5/1977 | Nikolic |
| 4,028,236 | A | 6/1977 | Townsend |
| 4,052,318 | A | 10/1977 | Krebs |
| 4,053,403 | A | 10/1977 | Beachgoer et al. |
| 4,078,040 | A | 3/1978 | Milkov |
| 4,094,777 | A | 6/1978 | Sugier |
| 4,108,770 | A | 8/1978 | Roy |
| 4,180,473 | A | 12/1979 | Maurer et al. |
| 4,219,419 | A | 8/1980 | Sweeny |
| 4,233,694 | A | 11/1980 | Janosko et al. |
| 4,241,025 | A | 12/1980 | Grayson et al. |
| 4,257,893 | A | 3/1981 | Burton |
| 4,303,441 | A | 12/1981 | Lamisse |
| 4,309,992 | A | 1/1982 | Dodak et al. |
| 4,337,136 | A | 6/1982 | Dahlgren |
| 4,340,039 | A | 7/1982 | Hibbard et al. |
| 4,340,982 | A | 7/1982 | Hart et al. |
| 4,349,434 | A | 9/1982 | Jaworski |
| 4,359,790 | A | 11/1982 | Chalberg |
| 4,382,865 | A | 5/1983 | Sweeny |
| 4,385,989 | A | 5/1983 | Margolis |
| 4,414,115 | A | 11/1983 | The |
| 4,416,854 | A | 11/1983 | Nielsen |
| 4,420,463 | A | 12/1983 | Pocius et al. |
| 4,421,652 | A | 12/1983 | Heskett |
| 4,426,286 | A | 1/1984 | Puckett et al. |
| 4,504,387 | A | 3/1985 | LeMire et al. |
| 4,519,914 | A | 5/1985 | Etani |
| 4,533,476 | A | 8/1985 | Watkins |
| 4,552,658 | A | 11/1985 | Adcock et al. |
| 4,584,106 | A | 4/1986 | Held |
| 4,610,783 | A | 9/1986 | Hudson |
| 4,630,634 | A | 12/1986 | Sasaki et al. |
| 4,637,873 | A | 1/1987 | DeSousa |
| 4,676,894 | A | 6/1987 | Diamond et al. |
| 4,692,314 | A | 9/1987 | Etani |
| 4,761,208 | A | 8/1988 | Gram et al. |
| 4,780,197 | A | 10/1988 | Schuman |
| 4,798,028 | A | 1/1989 | Pinion |
| 4,816,177 | A | 3/1989 | Nelson et al. |
| 4,817,214 | A | 4/1989 | Stuessy |
| 4,818,389 | A | 4/1989 | Tobias et al. |
| 4,857,112 | A | 8/1989 | Franninge |
| 4,867,196 | A | 9/1989 | Zetena et al. |
| 4,871,710 | A | 10/1989 | Denny |
| 4,876,003 | A | 10/1989 | Casberg |
| 4,880,547 | A | 11/1989 | Etani |
| 4,901,926 | A | 2/1990 | Klotzbach |
| 4,933,178 | A | 6/1990 | Capelli |
| 4,935,132 | A | 6/1990 | Nakashima et al. |
| 4,971,687 | A | 11/1990 | Anderson |
| 4,979,245 | A | 12/1990 | Gandini |
| 5,006,267 | A | 4/1991 | Vaughn et al. |
| 5,011,600 | A | 4/1991 | Mowka et al. |
| 5,029,594 | A | 7/1991 | Pierce, Jr. |
| 5,066,408 | A | 11/1991 | Powell |
| 5,076,315 | A | 12/1991 | King |
| 5,122,274 | A | 6/1992 | Heskett |
| 5,149,354 | A | 9/1992 | Delaney |
| 5,167,049 | A | 12/1992 | Gibbs |
| 5,198,118 | A | 3/1993 | Heskett |
| 5,202,020 | A | 4/1993 | Desjoyaux et al. |
| 5,204,004 | A | 4/1993 | Johnston et al. |
| 5,236,581 | A | 8/1993 | Perry |
| 5,238,585 | A | 8/1993 | Reed |
| 5,252,211 | A | 10/1993 | Searfoss, Jr. |
| 5,277,802 | A | 1/1994 | Goodwin |
| 5,314,623 | A | 5/1994 | Heskett |
| 5,328,602 | A | 7/1994 | Brooks |
| 5,332,511 | A | 7/1994 | Gay et al. |
| 5,347,664 | A | 9/1994 | Hamza et al. |
| 5,352,369 | A | 10/1994 | Heinig, Jr. |
| 5,372,714 | A | 12/1994 | Logue, Jr. |
| 5,383,239 | A | 1/1995 | Mathis et al. |
| 5,392,472 | A | 2/1995 | Maxfield |
| 5,405,614 | A | 4/1995 | Ohsumi et al. |
| 5,409,608 | A | 4/1995 | Yoshida et al. |
| 5,441,529 | A | 8/1995 | Dorsch |
| 5,441,711 | A | 8/1995 | Drewery |
| 5,507,948 | A | 4/1996 | Wargo et al. |
| 5,525,215 | A | 6/1996 | Marchionda |
| 5,536,393 | A | 7/1996 | Weeks |
| 5,575,925 | A | 11/1996 | Logue, Jr. |
| 5,656,159 | A | 8/1997 | Spencer et al. |
| 5,681,988 | A | 10/1997 | Koch et al. |
| 5,743,287 | A | 4/1998 | Rauchwerger |
| 5,755,962 | A | 5/1998 | Gershenson et al. |
| 5,762,797 | A | 6/1998 | Patrick et al. |
| 5,779,913 | A | 7/1998 | Denkewicz, Jr. et al. |
| 5,785,845 | A | 7/1998 | Colaiano |
| 5,799,339 | A | 9/1998 | Perry et al. |
| 5,810,043 | A | 9/1998 | Grenier |
| 5,810,999 | A | 9/1998 | Bachand et al. |
| 5,820,762 | A | 10/1998 | Bamer et al. |
| 5,824,218 | A | 10/1998 | Gasser et al. |
| 5,824,243 | A | 10/1998 | Contreras |
| 5,853,581 | A | 12/1998 | Rayborn et al. |
| 5,857,594 | A | 1/1999 | Ozturk |
| 5,862,545 | A | 1/1999 | Mathis et al. |
| 5,868,933 | A | 2/1999 | Patrick et al. |
| 5,888,384 | A | 3/1999 | Wiederhold et al. |
| 5,888,386 | A | 3/1999 | Enright et al. |
| 5,888,392 | A | 3/1999 | Frizell |
| 5,919,554 | A | 7/1999 | Watterson, III et al. |
| 5,928,510 | A | 7/1999 | Meredith |
| 5,932,093 | A | 8/1999 | Chulick |
| 5,935,518 | A | 8/1999 | Richard et al. |
| 5,954,952 | A | 9/1999 | Strawser, Sr. |
| 5,980,740 | A | 11/1999 | Harms et al. |
| 5,980,761 | A | 11/1999 | Boissie et al. |
| 6,019,893 | A | 2/2000 | Denkewicz, Jr. et al. |
| 6,030,632 | A | 2/2000 | Sawan et al. |

| | | | |
|---|---|---|---|
| 6,038,712 | A | 3/2000 | Chalberg et al. |
| 6,065,161 | A | 5/2000 | Mateina et al. |
| 6,066,253 | A | 5/2000 | Idland et al. |
| 6,086,758 | A | 7/2000 | Schilling et al. |
| 6,122,775 | A | 9/2000 | Jacuzzi et al. |
| 6,130,603 | A | 10/2000 | Briechle |
| 6,138,703 | A | 10/2000 | Ferguson |
| 6,153,095 | A | 11/2000 | Francisco |
| 6,162,401 | A | 12/2000 | Callaghan |
| 6,165,358 | A | 12/2000 | Denkewicz, Jr. et al. |
| 6,170,095 | B1 | 1/2001 | Zars |
| 6,171,496 | B1 | 1/2001 | Patil |
| 6,182,681 | B1 | 2/2001 | Robertson et al. |
| 6,190,547 | B1 | 2/2001 | King et al. |
| 6,199,224 | B1 | 3/2001 | Versland |
| 6,214,217 | B1 | 4/2001 | Sliger, Jr. |
| 6,238,575 | B1 | 5/2001 | Patil |
| 6,269,493 | B2 | 8/2001 | Sorensen |
| 6,270,662 | B1 | 8/2001 | Gibson et al. |
| 6,274,036 | B1 | 8/2001 | Ellis |
| 6,279,177 | B1 | 8/2001 | Gloodt |
| 6,280,617 | B1 | 8/2001 | Brandreth, III |
| 6,282,370 | B1 | 8/2001 | Cline et al. |
| 6,283,308 | B1 | 9/2001 | Patic et al. |
| 6,287,466 | B1 | 9/2001 | Yassin |
| 6,289,530 | B1 | 9/2001 | Miller et al. |
| 6,294,095 | B1 | 9/2001 | Lewis |
| 6,298,871 | B1 | 10/2001 | Pickens et al. |
| 6,308,350 | B1 | 10/2001 | Marchionda |
| 6,317,903 | B1 | 11/2001 | Brunelle et al. |
| 6,328,900 | B1 | 12/2001 | King |
| 6,331,432 | B1 | 12/2001 | Bautista et al. |
| 6,340,431 | B2 | 1/2002 | Khan |
| 6,342,841 | B1 | 1/2002 | Stingl |
| 6,357,060 | B2 | 3/2002 | Gloodt |
| 6,358,405 | B1 | 3/2002 | Leahy |
| 6,358,425 | B1 | 3/2002 | King |
| 6,390,340 | B1 | 5/2002 | Lynch, Sr. |
| 6,391,167 | B1 | 5/2002 | Grannersberger |
| 6,395,167 | B1 | 5/2002 | Mattson, Jr. et al. |
| 6,405,387 | B1 | 6/2002 | Barnes |
| 6,409,864 | B1 | 6/2002 | Choi |
| 6,419,839 | B1 | 7/2002 | Cox et al. |
| 6,419,840 | B1 | 7/2002 | Meincke |
| 6,444,129 | B1 | 9/2002 | Collins |
| 6,460,894 | B1 | 10/2002 | Weh et al. |
| 6,471,856 | B1 | 10/2002 | Keith |
| 6,497,822 | B2 | 12/2002 | Blanchette et al. |
| 6,500,332 | B2 | 12/2002 | Martin et al. |
| 6,511,605 | B2 | 1/2003 | Connelly, Jr. |
| 6,517,727 | B2 | 2/2003 | Pickens et al. |
| 6,523,192 | B1 | 2/2003 | Gloodt |
| 6,540,916 | B2 | 4/2003 | Patil |
| 6,544,415 | B2 | 4/2003 | King |
| 6,558,538 | B2 | 5/2003 | Sciuilla et al. |
| 6,562,242 | B2 | 5/2003 | King et al. |
| 6,592,341 | B1 | 7/2003 | Olney |
| 6,592,766 | B2 | 7/2003 | King |
| 6,623,634 | B1 | 9/2003 | Whitehurst |
| 6,630,106 | B1 | 10/2003 | Levy |
| 6,641,787 | B1 | 11/2003 | Siggins et al. |
| 6,651,825 | B2 | 11/2003 | Turner, Jr. et al. |
| 6,666,974 | B2 | 12/2003 | Page |
| 6,676,842 | B2 | 1/2004 | Scuilla et al. |
| 6,688,490 | B2 | 2/2004 | Carlson |
| 6,722,384 | B2 | 4/2004 | Gates |
| 6,749,746 | B2 | 6/2004 | Mokrzycki |
| 6,760,931 | B1 | 7/2004 | Mattson, Jr. et al. |
| 6,792,925 | B2 | 9/2004 | Dworatzek et al. |
| 6,797,028 | B2 | 9/2004 | Duffy |
| 2001/0003217 | A1 | 6/2001 | Sorensen |
| 2001/0013373 | A1 | 8/2001 | Wright |
| 2001/0027573 | A1 | 10/2001 | Gloodt |
| 2002/0113025 | A1 | 8/2002 | Gauldin et al. |
| 2002/0117432 | A1 | 8/2002 | Lincke |
| 2003/0029789 | A1 | 2/2003 | Patil |
| 2003/0113378 | A1 | 6/2003 | Laridon et al. |
| 2003/0150796 | A1 | 8/2003 | Heinig, Jr. |
| 2003/0178374 | A1 | 9/2003 | Arsta |
| 2003/0213059 | A1 | 11/2003 | Mattson, Jr. et al. |
| 2004/0025249 | A1 | 2/2004 | Desmond |
| 2004/0168249 | A1 | 9/2004 | Gerth et al. |
| 2004/0168962 | A1 | 9/2004 | Mattson et al. |
| 2004/0188346 | A1 | 9/2004 | Clive et al. |
| 2004/0250344 | A1 | 12/2004 | Selover |

FOREIGN PATENT DOCUMENTS

| | | |
|---|---|---|
| JP | 4-214150 | 1/1992 |
| JP | 7-80218 | 3/1995 |
| JP | 10-192847 | 7/1998 |
| JP | 11-267414 | 10/1999 |

OTHER PUBLICATIONS

Antimicrobial Alphasan® Test Report Summary Table, Milliken Chemical, Mar. 14, 2003.

Jacuzzi Builders Comfort Bath Series, Installation and Operating Instructions, K172000 AC, Dec. 2004.

Eljer Contractor Series Whirlpools, Installation/Operating Instructions.

Costerton, William J., Frequently Asked Questions, SaniJet Web Site.

Costerton, William J., Bio Films, A Growing Problem.

Decorative Plumbing, F.A.Q. No. 4. Airtub. Sep. 12, 2000.

Pasko-Kolva, Christine, Environmental Group Leader, SaniJet Website.

Budgell, Scott and Thompson, Bernice, "Hydrotherapy Tub Usage".

Merrim-Webster Online Dictionary, "whirlpool bath".

Moyes, Rita, SaniJet Web Site.

U.S. Environmental Protection Agency, "What is Ozone".

Canadian Infectious Control Guidelines for Long-Term Facilities, pp. 8-9, rev. 1993.

Class Action Reporter, Nov. 19, 2001, vol. 3, No. 226.

Lasco Bathware, Inc., Acrylic Builder's Choice Whirlpool Alydar I & II, Information Page.

American Standard Bathroom Fixtures and Faucets. Product Details, Internet Web Page at www.americanstandard-us.com, Apr. 14, 2004.

Donley, Kelli M., "Relaxing in Filth: What Your Hot Tub May Be Hiding".

"Ozone Generators That Are Sold as Air Cleaners: An Assessment of Effectiveness and Health Consequences", http://www.epa.gov//ag/pubs/ozonegen.html#how%20is%20harmful, visited Jan. 18, 2005.

Lasco Cleaning-Circulation System, pp. 19 and 24.

FILL AND DRAIN JETTED HYDROMASSAGE ANTIMICROBIAL WATER VESSEL

REFERENCE TO RELATED APPLICATION

This non-provisional utility application is a continuation of parent application Ser. No. 11/114,844, filed Apr. 26, 2005, which is now U.S. Pat. No. 6,971,125, which is a continuation of Ser. No. 10/841,925, filed May 7, 2004, now abandon, which is a divisional of Ser. No. 10/211,497 filed Aug. 2, 2002, titled Non-Electric Sanitation Water Vessel System, which is now U.S. Pat. No. 6,760,931.

FIELD OF THE INVENTION

The present invention relates to a fill and drain jetted acrylic hydromassage water vessel having a water vessel system for water flow, acrylic, fiberglass, resin, a tub, at least one jet that provides a hydromassage, at least one water piping system and a water pump and where components are made of a material having an antimicrobial therein to provide for reduction of bacteria

BACKGROUND

Whirlpool bathtubs have been employed to treat discomfort resulting from strained muscles, joint ailments and the like.

To create the desired whirlpool motion and hydromassage effect, a motorized water pump draws water through a suction fitting in a receptacle, such as a bathtub. The user first fills the bathtub. Then the user activates the closed loop whirlpool system. The water travels through a piping system and back out jet fittings. Jet fittings are typically employed to inject water at a high velocity into a bathtub. Usually the jet fittings are adapted to aspirate air so that the water discharged into the receptacle is aerated to achieve the desired bubbling effect. See for instance, U.S. Pat. No. 4,340,039 to Hibbard et al., incorporated herein by reference. Hibbard et al also teaches one whirlpool bathtub having jet components. U.S. Pat. No. 6,395,167 to Mattson, Jr. et al. ("Mattson"), which is incorporated herein by reference teaches another embodiment of a whirlpool bathtub.

Generally, whirlpool baths are designed as with a normal bathtub to be drained after each use. However, debris in the form of dead skin, soap, hair and other foreign material circulates throughout the piping and pump system. This debris does not completely drain and over time, accumulates in the piping system and may cause a health risk.

OVERVIEW

Therefore, filtration system designed for whirlpool baths is desirable. In one embodiment of the present invention, Mattson provides for a filtration system, which filters debris in the water with respect to whirlpool baths. One embodiment of the invention improves upon other Mattson filtration system for whirlpool baths. Before Mattson, filtration systems were found only in indoor and outdoor pools and spas.

For some time, whirlpool bath manufacturers have tried to devise a way to incorporate a filtration system on a closed loop whirlpool bath. Although many problems exist, compliance with the plumbing codes is the major obstacle faced in using a filtration system for a whirlpool bath. Until Mattson, there was no filtration system that specifically designed for a drain down whirlpool bath that allows a whirlpool bath to pass requirements set forth by the current plumbing code.

Whirlpool baths must meet stringent drain down code requirements set up by the American Society of Mechanical Engineers (ASME). The code that governs whirlpool baths is entitled "Whirlpool Bath Appliances" (ASME A112.19.7M 1995). Section 5 of this code covers water retention and provides: "whirlpool bath appliances shall be of such design as to prevent retention of water in excess of 44 ml. (1½ fl oz) for each jet and suction filter."

The average whirlpool bath has a six-jet system and has one suction fitting. In order to meet code, a six-jet/one suction system configuration may only retain 10 ½ ounces of water in the complete whirlpool bath system after draining. Most quality whirlpool baths, however, retain less than 4 ounces of water in the whirlpool bath system after draining. The filter part of the system cannot retain over 6½ ounces of water, because the total water retention would then exceed 10 ½ ounces. Mattson is currently the only known filtration system designed for whirlpool bathtubs that retains less than 6½ ounces of water. The complete filtration system of one embodiment of present invention, however, retains less than 4 ounces of water and as little as 2 ounces of water; so most whirlpool bath companies could use it on their whirlpool bath models and pass the drain down codes for whirlpool baths.

Another important consideration in developing a filtration system for whirlpool baths is the ease of replacing the filter. To eliminate access panels on the underside of the whirlpool bath, which are used to access the filter, the filtration system was designed so the filter could be replaced from inside the bath. Therefore, the most logical choice for a filter location is in the suction fitting. However, placing the filter in the suction fitting presents a different range of design concerns. For example, placing a filter in the suction fitting may cause undue stress on the pump motor.

The suction filter must pass the codes set up by ASME for suctions, which include a variety of load and structural tests. The code for suctions from ASME is titled Suction Fittings For Use in Swimming Pools, Spas, Hot Tubs, and Whirlpool Bathtub Appliances (ASME/IAMPO reaffirm 1996). Presently there is only one patented whirlpool bathtub suction filter that passes ASME code to be placed on a whirlpool bathtub. See Mattson incorporated herein. One embodiment of the present invention provides a cavity that houses a filter that could be installed in such a way that the filter is replaced from the inside of a whirlpool bath.

The filter was designed to be small to meet the drain down requirements. Because of its small size, however, it also had to be very efficient. Therefore, one embodiment of present invention has a specially designed filter core. The core is engineered with varying spaced and sized holes along the length of the core. This design allows water to be drawn through the entire filter. Without this design, the filter would only pull water through about 20% of the filter near the outlet.

Other problems in whirlpool bathtub and spa use are encountered when a user's hair is twisted and entrapped in the whirlpool bath pump impeller. Hair entrapment occurs when a bather's hair becomes entangled in a suction fitting drain cover as the water and hair are drawn powerfully through the drain. The Consumer Product Safety Commission has issued a safety alert article entitled "Children Drown and More Are Injured From Hair Entrapment In Drain Covers For Spas, Hot Tubs, And Whirlpool Bathtubs" (CPSC Document #5067). The safety alert urges consumers to ask their spa, hot tub, and whirlpool bathtub dealers for drain covers that meet voluntary standard ASME/ANSI A112.19.8M 1987) to help reduce hair entrapment. One embodiment of the present invention meets the voluntary ASME/ANSI standard.

One embodiment of the present invention also provides a new faceplate cover, which is easily removable. The faceplate also has to pass the heavy load, impact and hair entrapment tests set out by ASME/IAMPO. One cover embodiment has a radius and back ribbing on it and a removable insert support to pass the strength tests. An embodiment of the faceplate is flat with structural fins on its backside, thus eliminating the removable insert. Each cover has a sufficient number of sized holes to pass the prescribed hair entrapment tests. The result is the fluid suction filter device that is especially made just for whirlpool baths.

In the safety alert CPSC Document #5067, the Consumer Product Safety Commission suggests that consumers shut down the spa until the drain cover is replaced in the event that the consumer discovers the drain cover missing or broken. One embodiment of the present invention allows the water system to shut itself down if the faceplate drain cover is missing or broken by means of a non-electric cavitation mechanism. The water system is also shut down if a clog occurs.

It is found that even after debris is filtered from a whirlpool bathtub, trace amounts of bacteria still can grow in a whirlpool bathtub. In fact, even if normal tap water where to be run through the closed looped system of a whirlpool bathtub, trace amounts of bacteria can form in the whirlpool bathtub's closed looped piping system. To eliminate these trace bacteria, a special filter core with an antimicrobial chamber was developed.

This antimicrobial chamber emits antimicrobial agents to kill the trace bacteria that may grow in the whirlpool bathtub's closed looped piping system, upon initial whirlpool bathtub activation and between usages. However, most of the antimicrobial agents would dissipate as soon as they enter the inside of the bathtub where people bathe. In other words, due to breakdown and dissipation, the antimicrobial agents do not build up in the bath water as the whirlpool operates. Therefore, the user may activate the antimicrobial dispenser mechanism to distribute antimicrobial agents at will or on a timed basis. The antimicrobial dispenser is a top filled design not known in the prior art. Another embodiment teaches the use of multiple chambers wherein each chamber is used for additional additives desired by the user.

Only a very small amount of antimicrobial agent is necessary to kill the bacteria in the closed looped piping system since the filter helps to trap hair, soap and other debris, which provides food for bacterial growth. In one embodiment of the invention without the filter a greater amount of antimicrobial agent would need to be introduced into the system to kill the bacteria and this excessive amount could irritate the skin of sensitive bathers.

Another integral part of creating one embodiment of a total water vessel sanitation system is to include antimicrobial additives in each component of the water vessel. With respect to whirlpool bathtubs and spas, this would include at least the system's water and air pipes, pump, and pump impellor. The surfaces of whirlpool bathtubs and spas are comprised primarily of a thermo-formed acrylic or plastic sheet or gelcoat paint. Therefore, in one embodiment of a total water sanitation system, the acrylic or plastic sheet or the gelcoat paint would require antimicrobial additives. In one embodiment the fiberglass and resin reinforcement backing of the whirlpool bathtub and spa are impregnated with antimicrobial additives, as are the whirlpool bathtub jets and suctions. While the technology exists to add antimicrobial additives to a whirlpool bathtub and spa component, there is no prior art that shows antimicrobial additives placed in one or more components or in combination with all components to provide for optimum protection from bacteria.

U.S. Pat. No. 6,395,167 (2002) to Mattson, Jr. et al. discloses a one embodiment of whirlpool bath with combination suction fixture and disposable filter feature.

U.S. Pat. No. 6,283,308 (2001) to Patil et al. discloses a bacteriostatic filter cartridge having elements impregnated with an anti-microbial agent.

U.S. Pat. No. 5,799,339 (1998) to Perry et al. discloses a suction device for a spa with a plumbing system.

One embodiment of the present invention features a suction filter is comprised of the filter core, the filter, and the filter housing. The filter core has a plurality of water draw holes having increasing diameters extending away from the water outlet. These holes provide for water draw along the entire length of the filter, instead of just making use of the filter at the outlet and of the filter. These increasing and decreasing holes provide for optimum water draw through the filter that surrounds the core. The filter core has a 2" inside diameter (I.D.) to assure over 200 GPM water flow draw rates. Without this I.D., you would not be able to get 200 GPM to run through the filter core allowing a combination filter suction an overall 200 GPM rating. No other manufacturer makes a filter for whirlpool bathtubs or even a filter that fits into a housing outlet with a 2" I.D. The core is made from injected plastic but could be machined from metal or a variety of other materials.

In one embodiment the filter core has an antimicrobial chamber that houses antimicrobial additives. The antimicrobial chamber measures approximately 1" to 8" in length and ½' to 2" in diameter. The antimicrobial additives used in the antimicrobial chamber could be slow dissolving chlorine, bromine, or a variety of other antimicrobial additives. The cover to the antimicrobial chamber has an adjusting hole opening which can be increased or decreased by turning the main body of the antimicrobial chamber in one direction or another. The more the antimicrobial chamber is screwed on, the smaller the hole opening becomes. The antimicrobial chamber has one hole but could have multiple holes or slots. The filter core's plastic is injected with antimicrobial additives during the injected molding process and inhibits any germ growth on the core between uses.

Multiple chambers may be added on the filter core along with the antimicrobial chamber for the addition of other additives. For example, the filter core may have a built in ion exchange chamber allowing for a built in water softener that softens the bathwater. It may also have a fragrance chamber that emits fragrances into the bathwater. Both of these items are not known in prior art for a suction filter core for a whirlpool bathtub or spa In one embodiment of the present invention water flows past the antimicrobial chamber creating a vacuum, which pulls a small quantity of antimicrobial additive from the chamber, thereby mixing it with the water. The amount of antimicrobial additives mixed into the water is in sufficient quantities to kill the trace bacteria that may grow between whirlpool bath usages in a filtered whirlpool bathtub system. The antimicrobial additives dissipate by the time the antimicrobial additives mix and enter the larger volume of water in the bathing area.

A filter which is generally treated with antimicrobial additives either slips over the filter core or is bonded onto the core making a one-piece filter core combination. Although the filter could be pleated or non-pleated, one embodiment has a two staged pleat filter media. The first pleat has larger holes, which allow larger sized particles and debris to pass through the antimicrobial treated filter pleat. The second pleat has smaller openings allowing only microscopic debris particles to pass through the treated filter pleat. Although microscopic debris may accumulate in the space between the inner and outer pleats, both filter media are impregnated with antimicrobial agents, which kill bacteria, which would accumulate on the pleats. Together, the inner and outer pleats create a halo effect killing of the bacteria, which accumulates between the inner, and outer filter media. This layered filter design is important in decreasing the build up of debris on the outer layer of the filter which nearest to the bather.

The filter media is preferably made out of polypropylene or other media that will accept antimicrobial agents. In the spa industry, polyester media is used. Polypropylene media can be treated in the manufacturing process with antibacterial agents, whereas polyester media cannot. In the whirlpool industry, however, filters were not used on whirlpool baths until an approved filtration system for whirlpool baths under the Mattson '167 patent.

One embodiment of the filter is designed to retain less than 3 ounces of water. The housing of the suction filter is generally cylindrical having a diameter of four inches to two feet. The filter housing is tapered from front to back to allow water to drain back into the tub after shutdown. This embodiment of the housing has tapered sides of the inner wall to allow water to drain back into the whirlpool bathtub when the whirlpool bathtub system is deactivated whether the unit is installed facing left or right. The filter housing has a sharp radius end opposite the outlet end, thus allowing the housing to be fitted into the sidewall of a tub through a standard size-opening cut.

With this embodiment the filter housing is mounted to the inner tub wall by using a screw and nut between the housing mounting flange and the inner tub wall. A gasket or silicone can be used between the outer tub wall and the screw and nut to prevent leaks.

In one embodiment the filter core fits into the filter housing in axial alignment with the filter housing's inlet opening. In other words, the filter is now perpendicular from that of U.S. Pat. No. 6,395,167. The filter core has two slots cut into the end that fits into the outlet of the filter housing. The filter housing has two male ridges, which make the filter core the only filter core that fits that particular housing. As set forth above, the filter core is designed with varying sized holes and slots. The holes furthest from the outlet port are larger than the holes near the outlet port. This allows water to pull through the entire filter.

In one embodiment the filter housing has a safety cavitation port located at the inside wall of the housing.

The faceplate cover described below has a cavitation port fin, which covers the non-electric cavitation port when the faceplate cover is attached to the filter housing. The cavitation port fin is one of four available cavitation port fins designed to fit into a receiving bracket adjacent to the cavitation porthole. If the filter were removed or if a person tried to operate the unit without the filter core covering this hole, air from the tube would be drawn into the pump and the pump would cavitate (draw more air than water). Since people have drowned by getting their hair caught in a suction cover while their head is below the tub waterline, this is an important feature. No user could run the unit without the filter in place. This feature also reduces the chance of drawing contaminants into the whirlpool bath system. Once contaminants such as hair are entrapped in the pump's impeller, the entire whirlpool bath system becomes contaminated until someone physically opens the whirlpool bath pump (a long and time consuming process usually requiring a professional), frees the entrapped hair, and sanitizes the complete system.

The filter core has a gasket that slides over the non-electric safety cavitation port. Without this gasket, the replaceable filter core could rub against the filter housing outlet and cause wear over the years to the filter-housing outlet.

In one embodiment the suction filter has been downsized to fit more whirlpool bathtubs. The downsized version attaches to the whirlpool bathtub with a nut, which eliminates the attachment screws of U.S. Pat. No. 6,395,167. With the smaller filter design, however, filter replacement is likely to occur more often.

One embodiment of the present invention has two lights that are placed in a visible position on the whirlpool bathtub. The lights are hooked up to the whirlpool bathtub pump with a vacuum switch. If the combination suction filter, filter media (removable filter) accumulates enough debris, this blockage on the filter triggers a vacuum switch, which senses the blockage, and a preferably red indicator light comes on that indicates to the bather that it is time to remove and clean the removable filter or simply replace it. Otherwise a preferably green indicator light stays on indicating to the bather that the filter is not ready for replacement.

One embodiment of the present invention also provides another means to indicate when to replace the filter. The end cap of the filter is treated with a special chemical in the manufacturing process, which creates a color reaction when the end cap is introduced to water. The first color would indicate the filter is not ready for replacement. The second color would indicate the filter should be replaced. For example, the end cap is white before water submersion. Once water is introduced to it, the reaction begins and the end cap will slowly turn to black over a predetermined period of time. During whirlpool bathtub operation but before the predetermined period of filter lifetime, the end cap color will range from white to varying shades of grey until it becomes totally black. Once it turns totally black, the bather knows it is time to replace the filter. This reaction may be have a time-release factor and can last from 1 to 360 days depending upon the amount of chemicals used in the end cap manufacturing.

Another inlet orifice may be added to the filter housing of one embodiment of the present invention. This orifice can be hooked up in tandem to a skimmer filter in a spa in order to filter water, which may bypass a filtration system. Currently spas, like whirlpool bathtubs, have one or multiple suction fittings that draw water into a pump and back out through jets. Although spas also have skimmers filters that draw surface water through the filters into a pump and back through the jets, the majority of the water passing through other suction points bypasses the filters in the skimmer causing contaminated water to circulate through the system. Most of the other suction points do not have filters. By replacing standard spa suction fittings with one embodiment of the present invention suction filter and hooking the outlet of the spa skimmer to one embodiment of the present invention suction filters, all water in a spa is filtered.

In one embodiment of the present invention the faceplate shown in FIGS. 4A through 4D slides into the housing to cover the suction filter assembly. The faceplate has a radius shape to prevent a limb from being sucked up against it, which could entrap a body part. ASME hair entrapment standards are met using a plurality of slots or holes. Impact and load tests are met.

In the embodiment of the faceplate shown in FIGS. 4B, 4C, support ribs (also known as support bars) are built into the faceplate and fit into receiving slots in the faceplate housing. This creates a solid part and allows it to pass impact and load tests called out by ASME code. This is the only suction faceplate for whirlpool bathtubs and spas that is designed with the structured supports in the faceplate. This allows a filter to be installed in the suction housing or replaced and still pass these test. All other known suctions have the main structured support as part of the body (housing) and these supports cannot be removed. See U.S. Pat. No. 5,799,339 to Perry et al., which represents all other known suctions. FIG. 5 of U.S. Pat. No. 5,799,339 shows a face view of the support. FIG. 3 shows how FIG. 5 screws in permanently into body 20 of FIG. 3. These supports (26*b*, 28*b* called a guide) cannot be removed once the suction is installed.

In one embodiment of the present invention the faceplate is larger than standard faceplates because of the size of the removable filter. In one embodiment of the present invention, Mattson teaches the combination of a filter and a suction in a single device. In one embodiment of the present invention, the faceplate has slots to allow a larger volume of water to pass through it. Because of the increased size of the faceplate the slots have to be designed and engineered in a radiating pattern. This is very important for the plastic injected molding process.

With the this design over a horizontal (see Perry '339 patent) or vertical design, the pressure of the injected plastic from the injection point of the mold (usually the injection point of a mold is located in the center of the mold) hits the small end of the slots instead of the wide end of the slots. The shorter end of the slot can withstand a great deal more pressure over time before failure than if the pressure were subjected to the wide side of the slots. This allows for much longer mold life and a more pleasing finished product. The radiating pattern of slots gives a straight-line flow to the outer edge of the faceplate part. U.S. Pat. No. 5,799,339 FIG. 4 shows a standard slot opening arrangement that represents the arrangement of slots used by manufacturers of slotted face faceplates. U.S. Pat. No. 6,038,712 to Chalberg et al. FIG. 2 shows circular hole openings, which represent how other faceplates are made. Slots are preferable over circular holes to increase flow.

In one embodiment of the faceplate housing eliminates the drain down slots of the original design because water now evacuates through the bottom slots of the faceplate.

To prevent people's hair or body parts from getting trapped in the exposed hole where the faceplate cover is removed during whirlpool bath operation, current ASME plumbing code requires that all suction faceplate covers be engineered so the faceplate cannot be removed without the use of a tool. Most suction covers attach the faceplate to the housing with a screw and a screwdriver is needed to remove the screw. See U.S. Pat. No. 6,038,712 FIG. 2, which shows screw hole openings and U.S. Pat. No. 5,799,339 FIG. 3 number 22, which shows the screw. There are some suction manufacturers that have a non-electric cavitation device in the faceplate of the suction, see Chalberg U.S. Pat. No. 6,038,712. If the face of the suction is restricted significantly, the unit cavitates and the suction against the faceplate decreases. However, these designs are still dangerous. Hair can still become twisted in the faceplate before the unit shuts down. It is thought that if hair enters the Chalberg '712 cover and the cover is blocked to cease suction action, the hair can be easily removed. However, when hair enters a suction cover a vortex may form behind the cover causing the hair to twist and tangle, thereby preventing removal. Once the hair is trapped, you need a tool like a screwdriver by code to take the faceplate off. The entrapped hair can trap the head of the user under the tub's waterline. Therefore, people still can drown with these devices.

As stated above, the code requirement for a tool to remove the faceplate is to prevent body parts or hair from getting trapped in the exposed housing support cross members (which are an integral nonremovable part of the suction body in the event that the faceplate of current suctions is removed. But because one embodiment of the present invention's suction filter will not operate without the filter in place, there is no need for the screw. In one embodiment of the present invention the faceplate preferably attaches to the faceplate housing with magnets. The magnet hole openings of the housing are recessed for flush mounting. They also are flat recessed.

With this embodiment of the present invention, there is no danger of limb entrapment because the system would simply not operate. If someone did get his or her hair caught in the faceplate while the filter was in place, the whole faceplate pops off easily as the faceplate is held in place by magnets. As soon as the faceplate pops off, the cavitation fin, which normally covers the safety cavitation port, would move out of place. Once the non-electric cavitation port is uncovered, the pump cavitates, thereby immediately preventing body limbs or hair from becoming entrapped in the exposed suction opening. The suction cover has a pull-tab on the cover to allow the bather to easily remove the cover when the whirlpool bath pump is in operation if desired. Depending on the alignment of the faceplate with the faceplate housing, the pull-tab could be at any of four locations, i.e., bottom, top, left, or right.

If the unit was to run without the faceplate cover, and hair is caught in the exposed filter, the filter itself also pops out easily. Therefore, there is no chance of getting entrapped if the filter is removed, because the unit will also cavitate under these circumstances.

In one embodiment of the present invention, we plan to have ASME revise their codes for suction covers to allow them to be removable without a tool such as a screwdriver.

U.S. patent application Ser. No. 09/417,156 SORENSEN, EDWIN C. shows a breakaway drain cover for a spa. Sorensen operates a magnetically actuated switch transmitting an electrical signal. It does not have a safe non-electrical safety cavitation port like one embodiment of the present invention has. People are concerned when any electrical signal is transmitted in a water vessel. U.S. patent application Ser. No. 2001/0013373 WRIGHT, JAMES R. shows a drain cover, which is similar to the drain cover of Sorensen.

Both these inventions are drain covers and not suction fittings because they do not conform to ASME suction fitting codes. Neither pass the ASME code requirements set out in Section 4 for "Suction Fittings For Use in Swimming Pools, Spas, Hot Tubs, and Whirlpool Bathtub Appliances" (ASME/ANSI A112.19M-1987 reaffirm 1996) and Section 7 ASME A112.19.7M-1995, the hair entrapment test. Sorensen uses a "snap fit" to attach the faceplate to a drain wall fitting that may present a wear problem over the years as the cover is repeatedly put on and taken off. One embodiment of the present invention uses earth magnets that will last the lifetime of the spa or bath it is placed on.

Further, the Sorensen invention does not claim, when used in conjunction with a whirlpool bath instead of a spa, that it will allow the whirlpool bath to meet the drain down requirements of ASME A112.19.7M-1995, "Whirlpool Bathtub Appliances." One embodiment of the present invention does so claim. Another advantage of this embodiment of the present invention over Sorensen is that the non-electric cavitation safety feature (combination port hole, air tube, faceplate, cavitation fin) costs a fraction of what a signal-transmitting device would cost to manufacture. Therefore, while there is prior art for electronics-based breakaway covers in a variety of inventions, there is no prior art for a breakaway cover that utilizes a cost saving non-electrical cavitation port. Being non-electrical makes this embodiment of the present invention very safe for whirlpool bath, spa and swimming pool applications.

In one embodiment of the present invention the faceplate back support ribbing is designed in an X pattern, which offers outstanding structural integrity. The circular ribbing adds tremendous strength to the center impact point of the faceplate.

In one embodiment the faceplate is designed to protrude less than ½" into the tub when attached to the faceplate housing. This streamlined design protrudes much less than most current suctions adding more room to the bathing area of the whirlpool bathtub.

In one embodiment the slotted holes on the top, sides and bottom of the faceplate extend outward keeping in line with the radiating design pattern on the face of the faceplate. This makes it an easier part to inject with plastic.

Because the center faceplate is an area that would have a high fluid intake flow, the center of the faceplate is solid. This solid center section evens out the water flow across the rest of the faceplate so that there are no areas of high flow that would create unwanted areas of high suction force.

In one embodiment the support bars (or ribs) are integrally formed on the backside of the faceplate. The support bars are at right angles to each other and extend between opposite sidewalls of the faceplate. The support bars do not obstruct any of the faceplate slots formed in the face and sidewalls of faceplate. This configuration advantageously prevents hair from entering a faceplate slot and becoming entangled by wrapping around both sides of a support bar.

In one embodiment the faceplate housing has a flange that provides a resting area for the peripheral ledge of the faceplate when the faceplate is attached to the housing. This resting area allows for weaker magnets to be used to keep the faceplate attached to the faceplate housing.

An important feature of one embodiment of the present invention suction filter is the use of an antimicrobial system that is air actuated by depressing a button located on the inside wall or rim of a whirlpool bathtub. When the button is depressed, antimicrobial additives are injected via a tube into the outlet opening of the suction filter. This allows the bather the opportunity to inject a larger amount of antimicrobial additives into the whirlpool bathtub prior to entering the bathtub to give an added safeguard that all bacteria is killed in a whirlpool bath that has not been in operation for an extended period of time. Depressing the button not only injects antimicrobial additives into the outlet of the housing, it disperses the additives. When the tub is filled with water, the injected additives travel first to the pump housing in a high concentration-(the pump housing is found to be the place where bacteria growth is the highest) and then throughout the rest of the closed looped piping system, all the while killing bacteria. The greater the period between uses, the more likely a larger amount of bacteria can form in the whirlpool bathtub's piping system. This safeguard ensures that when activated, the whirlpool bathtub will be bacteria-free even if months have passed since the whirlpool bathtub system was operated.

One embodiment of the present suction filter device could be designed in other configurations than its current square-shaped form. In one embodiment the unit could also be designed in a round form or any other shape or size. In one embodiment the filter and filter core could also be made shorter, longer, larger or smaller. In one embodiment the filter could be made smaller for less money to be disposable after each whirlpool bath use. In one embodiment the filter could even be designed in such a way to be incorporated into existing suctions with modification of those suctions. In one embodiment the filter media that filters the water could be pleated or wrapped without pleating around a filter core.

In one embodiment the housing could be designed to incorporate multiple filters. The ridges and slots at the end of the filter core could be made in a variety of shapes or locations to ensure the use of only one filter.

In one embodiment the main body housing could be vacuum formed and become an integral part of the whirlpool bathtub.

In one embodiment the magnets holding the faceplate to the housing could be larger or smaller and arranged in various other locations on each part. The amount of magnets used could be increased or decreased. In one embodiment the faceplate could also be attached using various snap-on configurations. An installation-sealing gasket could be used. In one embodiment of the present invention the slope in the sidewalls of the housing could be increased or decreased. In one embodiment the overall size of the suction filter could be increased or decreased.

In one embodiment the housing body, faceplate or filter core could be made from other material than injected plastic; it could be stamped or machined out of metal or other material.

In one embodiment the radiating slotted design of the faceplate could have a radiating round hole design.

In one embodiment the safety cavitation hole could be placed anywhere rearward on the outlet of the housing and be various sizes or have multiple openings.

In one embodiment the filter could have various sanitizing materials in its core such as slow dissolving chlorine tablets or other sanitizing material incorporated into the filter core.

In one embodiment the screw nut that attaches the housing to the sidewall of the whirlpool bathtub could have a washer or use locking nuts and have varying sizes and be made out of a variety of materials, including plastic and nylon or some space age material.

SUMMARY

The main aspect of one embodiment of the present invention is to provide a water vessel having hydromassage jets and a thermoformed acrylic/fiberglass tub where the water vessel system provides for bacteria reduction.

Other aspects of this invention will appear from the following description and appended claims, reference being made to the accompanying drawings forming a part of this specification wherein like reference characters designate corresponding parts in the several views.

BRIEF DESCRIPTION OF THE DRAWINGS

FIG. 1PP is a top perspective view of a whirlpool bath having the preferred embodiment of the suction filter installed therein.

FIG. 2PP is a top perspective view of the faceplate of the suction filter as viewed from the inside of the whirlpool bath shown in FIG. 1.

FIG. 3PP is an exploded view of the suction filter shown in FIG. 2.

FIG. 4PP is a back plan view of the faceplate shown in FIG. 2.

Before explaining the disclosed embodiments of the present invention in detail, it is to be understood that the invention is not limited in its application to the details of the particular arrangements shown, since the invention is capable of other embodiments. Also, the terminology used herein is for the purpose of description and not of limitation.

DETAILED DESCRIPTION OF DRAWINGS

Figure 1:
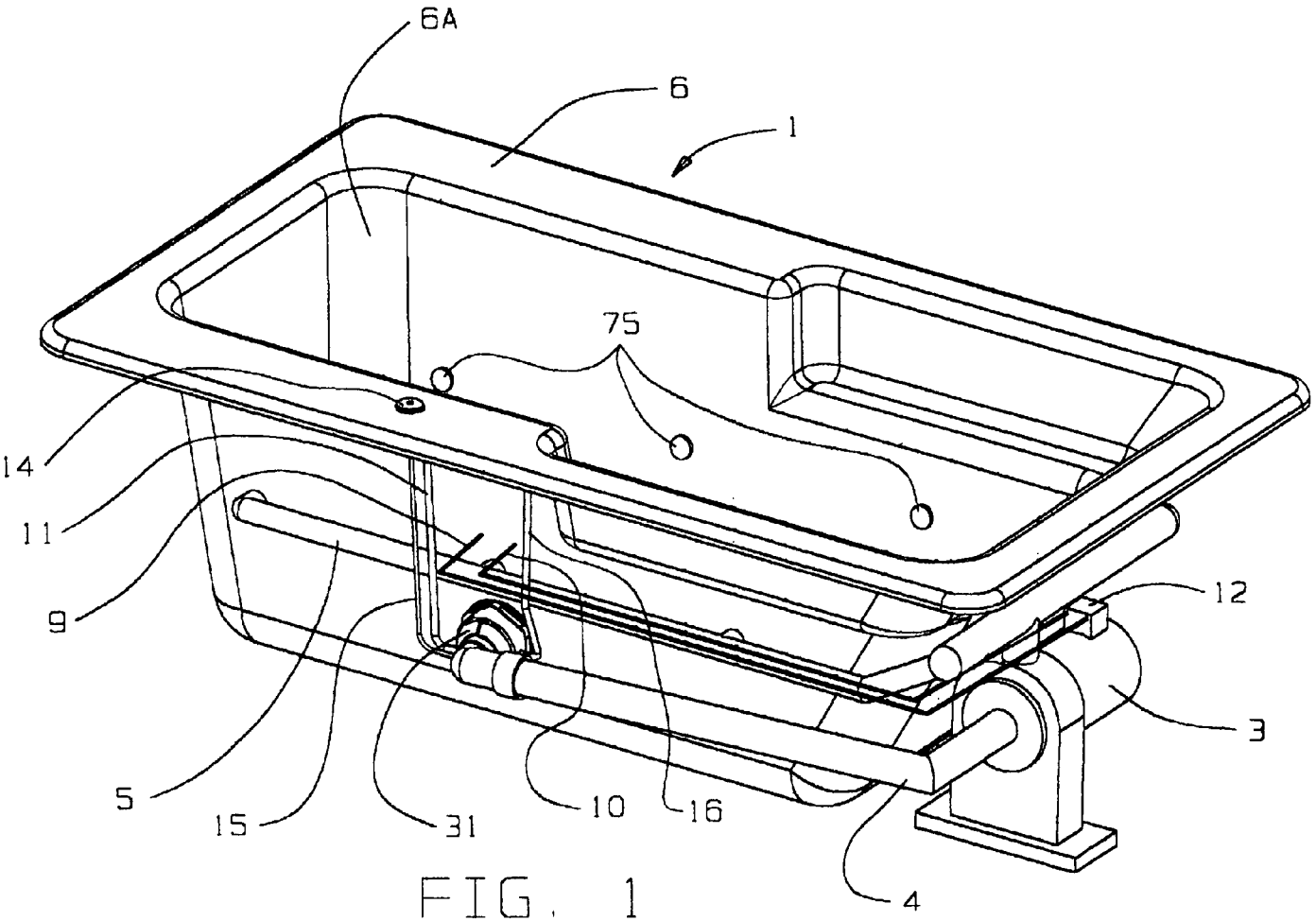
FIG. 1 is a top perspective view of one embodiment of a whirlpool bath having an embodiment feature of a suction filter and antimicrobial system installed therein.
Figure 14:
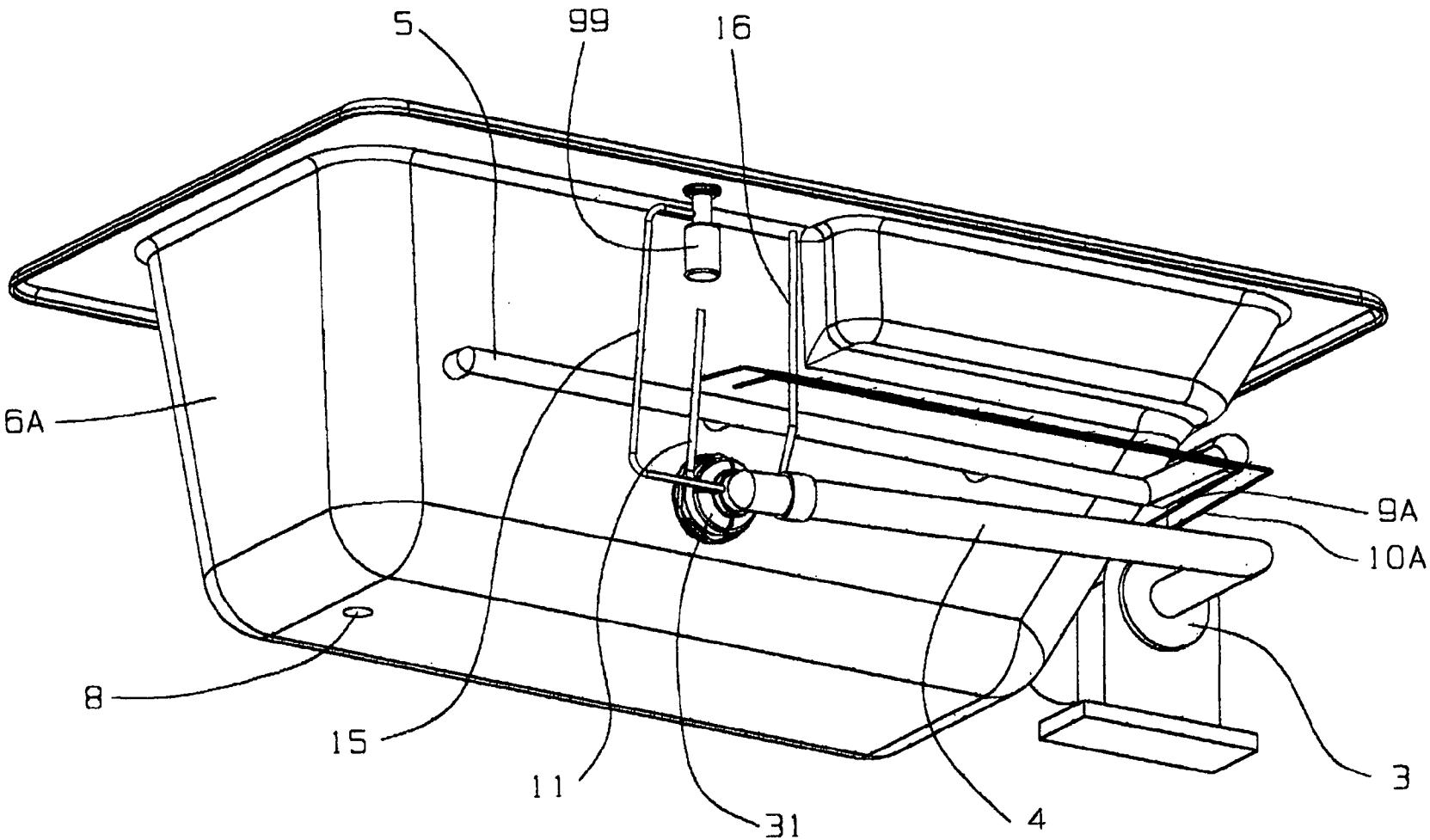
FIG. 14 is a bottom perspective view of a whirlpool bath of FIG. 1 showing an embodiment feature of the suction filter and antimicrobial dispenser installed therein.
Figure 15:
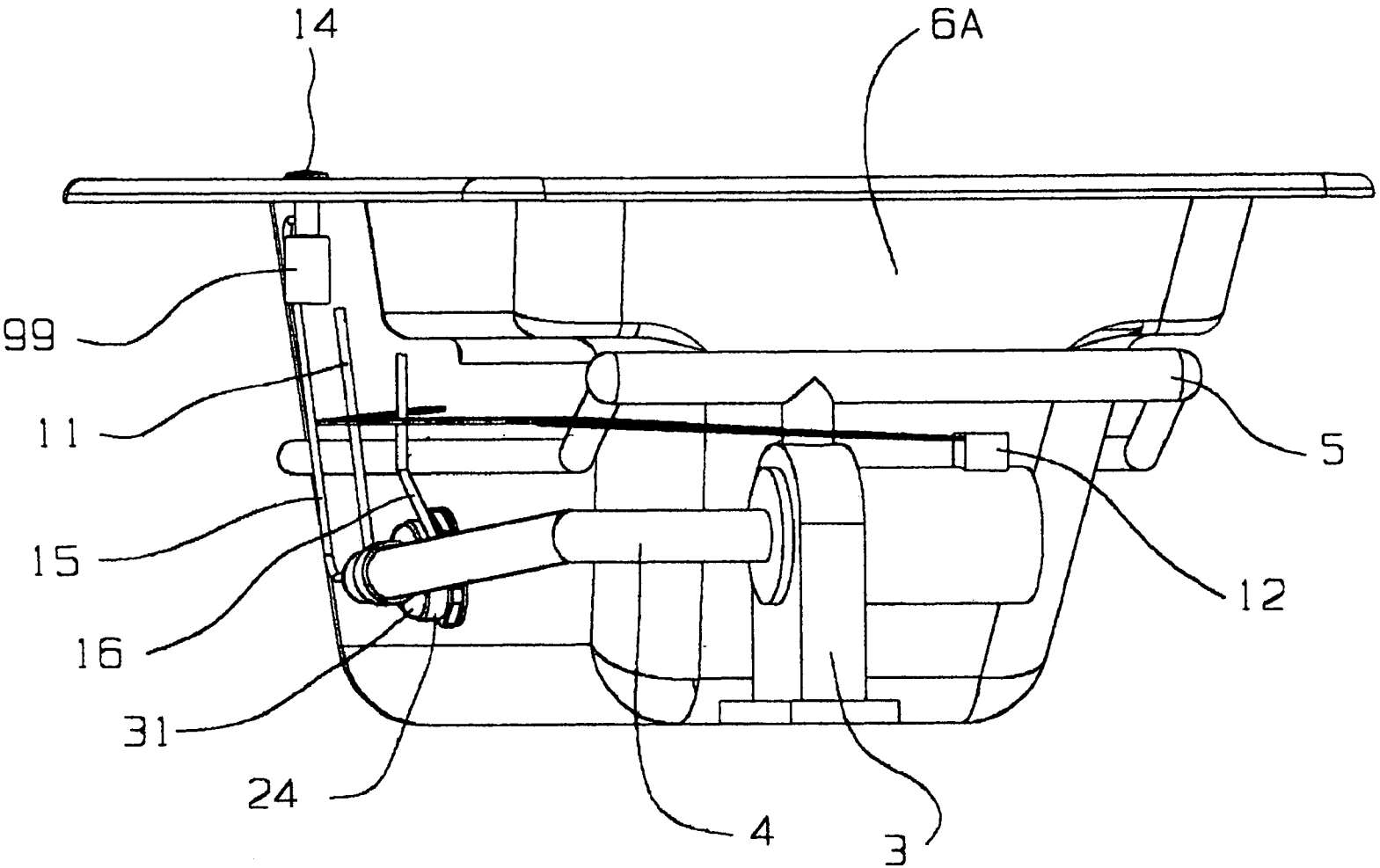
FIG. 15 is a plan view of the FIG. 1 whirlpool bath.

Referring first to FIGS. 1, 14, 15 a whirlpool bathtub water vessel 1 has a tub 6 with a standard tub wall 6A and a standard tub drain 8. During whirlpool use the pump 3 circulates water via outlet pipe 5 and jets 75. The whirlpool bathtub water vessel 1 also has an air-mixing pipe (not shown). Water is drawn from the filled tub 6 via pump inlet pipe 4, which is connected, to suction filter housing fitting 31. A switch 12 activates the pump 3. Filter sensing cavitation line 11 and faceplate sensing cavitation line 16 extend from suction filter housing 31. Sidewall 17 is sloped from position y to position X. Inlet pipe 4 cants downward from pump 3 to suction filter housing 31.

When filter-sensing line 11 detects a missing filter, the pump 3 cavitates. Likewise, when faceplate-sensing line 16 detects a missing or broken faceplate, pump cavitation occurs.

Injector button 14 is depressed to activate the antimicrobial additives dispenser 99 (see FIG. 14), which dispenses antimicrobial additives to water vessel 1 via antimicrobial line 15. Electric power lines 9A, 10A for green and red indicator lights 9, 10 respectively, connect to switch 12.

Figure 7:
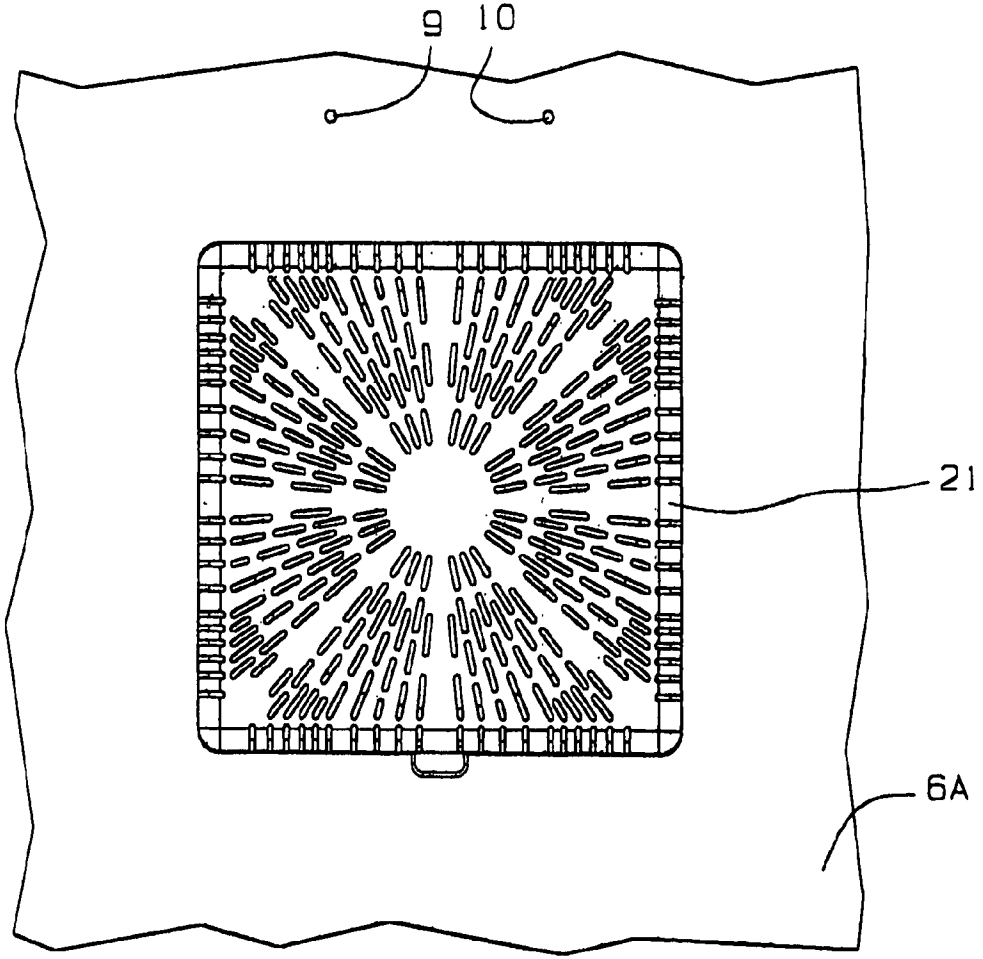
FIG. 7 is a plan view of the faceplate of the suction filter as viewed from the inside of the whirlpool bath shown in FIG. 1.

Referring next to FIG. 7, the suction filter 2 is shown as seen by a bather in the tub of FIG. 1. The only visible portion of the suction filter 2 is a the faceplate 21 attached to the inner tub wall 6A.

Two lights are shown placed near the inside wall 6A of the whirlpool bathtub near the suction filter 2. However, the lights may be placed anywhere on the tub wall. If the system detects a blockage of the filter 200 (see FIG. 8), a red indicator light 10 comes on that indicates to the bather that it is time to remove and clean the filter 200 or replaces it. Otherwise, green indicator light 9 stays on indicating to the bather that filter 200 is not ready for replacement.

Figure 2:
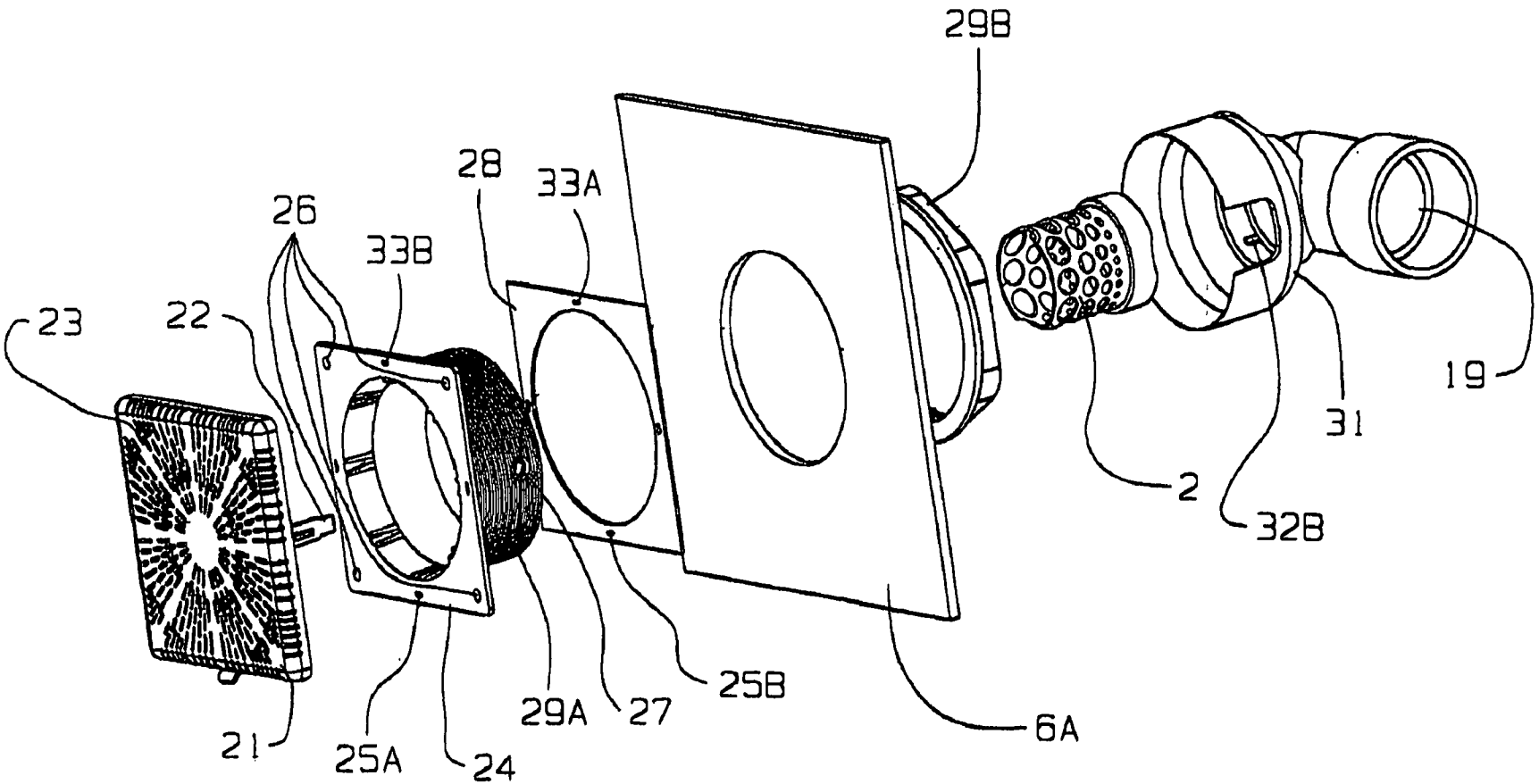
FIG. 2 is an exploded view of an embodiment of the faceplate and housing design for a suction filter apparatus and an embodiment of the suction filter apparatus.

FIG. 2 is an exploded view of an embodiment of the faceplate and housing for a suction filter apparatus and an embodiment of the suction filter apparatus. The faceplate 21 is preferably rectangular but could have any shape.

The faceplate housing 24 is attached to the inside surface of tub wall 6A by mounting the threaded portion 29A of faceplate housing 24 through gasket 28, wherein the female fittings 25A, 33B on faceplate housing 24 receive the male end 25B, 33A on gasket 28. The housing 24 is secured in placed by nut 29B on the outer surface (back side) of the tub wall 6A via a standard size-opening cut. Support rib 35 extends from faceplate 21 having slots 23 and slidably fits into receiving notch 56 (see FIG. 9). Any of four cavitation port fins 22 slidably fit into receiving bracket 37 to cover the cavitation porthole 44. Magnets 26 hold faceplate 21 to the faceplate housing 24. The faceplate is thus mounted inside tub 6. The faceplate 21 is preferably square but could have any shape.

Figures 5A, 5B, 5C:
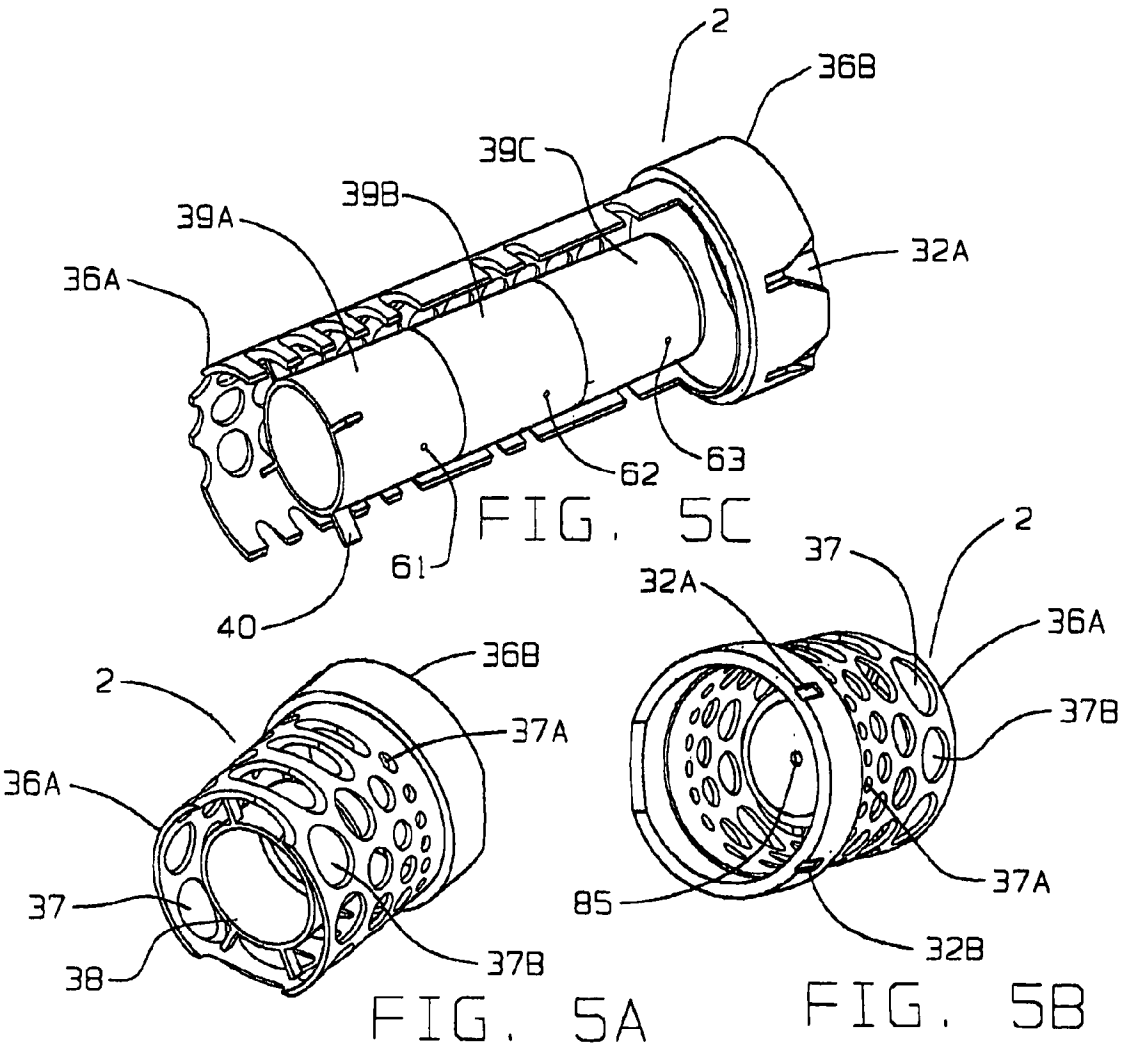
FIG. 5A is a top perspective view of one embodiment of the suction filter core.
FIG. 5B is a view from the opposite perspective view of the FIG. 5A suction filter core.
FIG. 5C is a top perspective view of another embodiment of the suction filter core depicting multiple chambers therein.

Filter core 2 is attached to filter housing 31 by male ridges 32B, which fit into receiving slots 32A on filter core 2 (see FIGS. 5B, 2). Water passes through filter core 2 and pump outlet 19, whereby the filtered water circulates back into the water vessel system. The filter housing 31 is attached to the inner tub wall 6A via screw nut 29B.

Figure 3B:
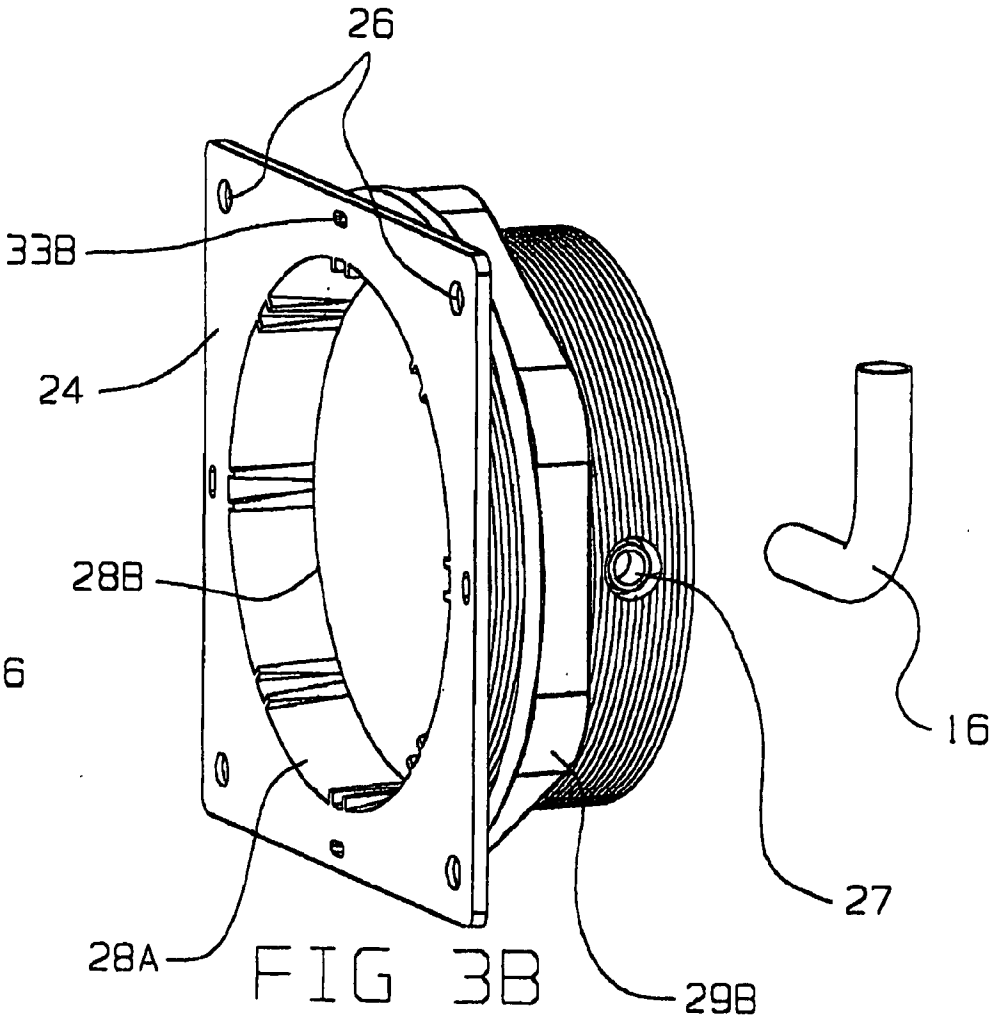
FIGS. 3A, 3B are right side perspective views of the faceplate housing shown in FIG. 2.
Figure 3A:
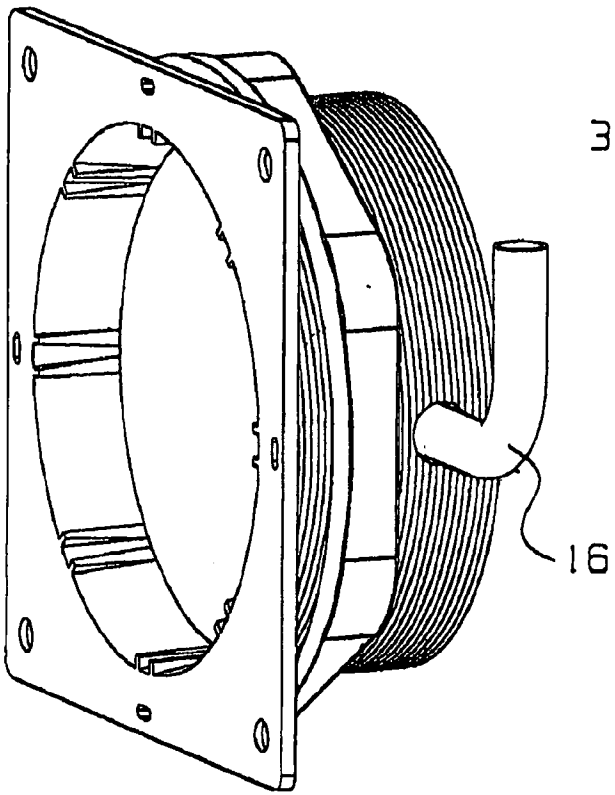

FIGS. 3A, 3B are right side perspective views of the faceplate housing shown in FIG. 2. Faceplate housing 24 has a sloped taper 28B (high end) to 28A (low end) to allow water to drain back into the tub after shutdown as shown in FIG. 3B. Recessed port 27 receives faceplate sensing cavitation line 16. FIG. 3A shows faceplate-sensing line 16 mounted on faceplate housing 24.

FIGS. 4A, 4B, 4C, 4D present different perspective views of faceplate 21 having a pull tab 45 which facilitates the removal of the faceplate 21 if desired. The faceplate slots 23 which are designed and engineered in a radiating pattern allow a larger volume of water to pass through the faceplate 21, thereby entering filter housing 31.

Figure 4B:
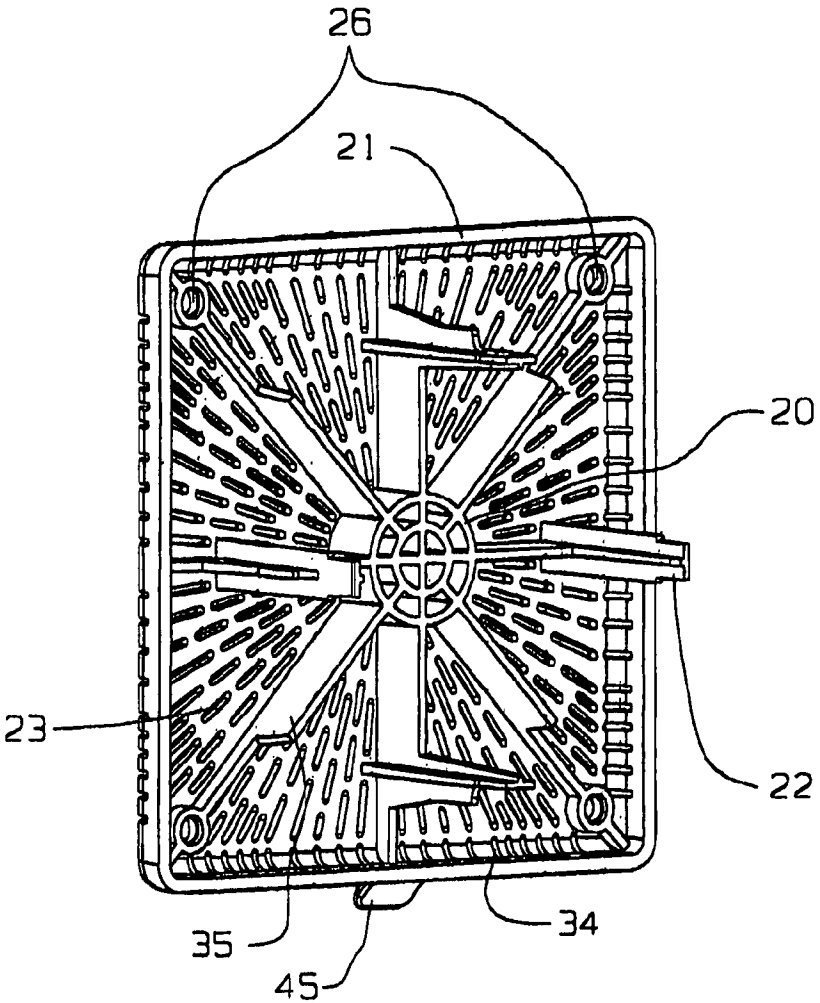
FIGS. 4A, 4B, 4C, 4D present different perspective views of a faceplate embodiment having a pull-tab to facilitate the faceplate removal if desired.
Figure 4A:
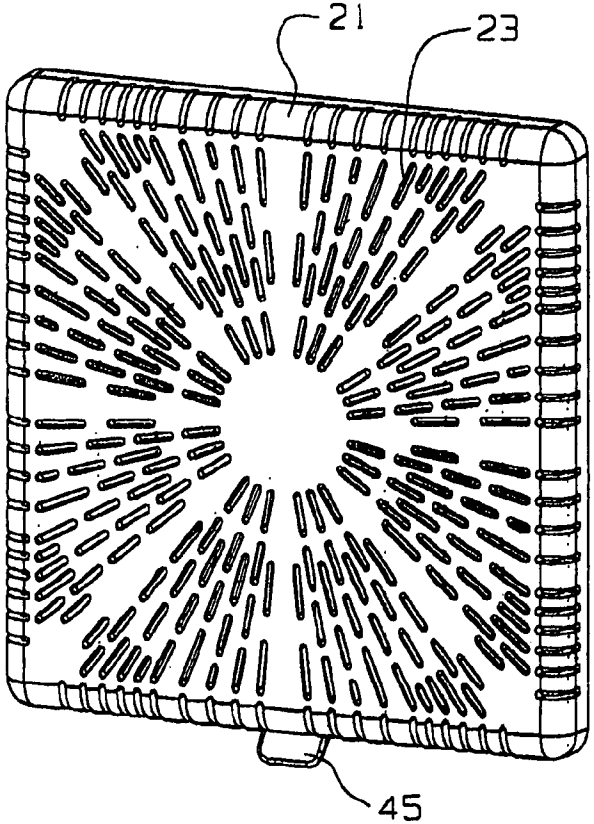
Figure 4D:
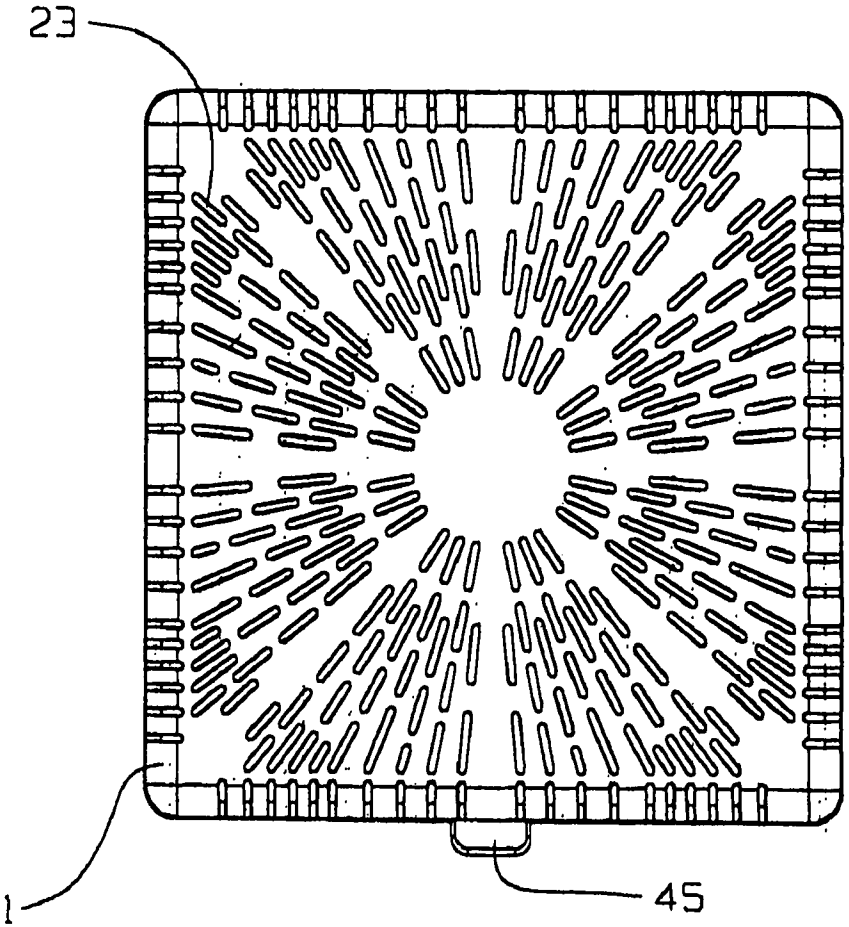
Figure 4C:
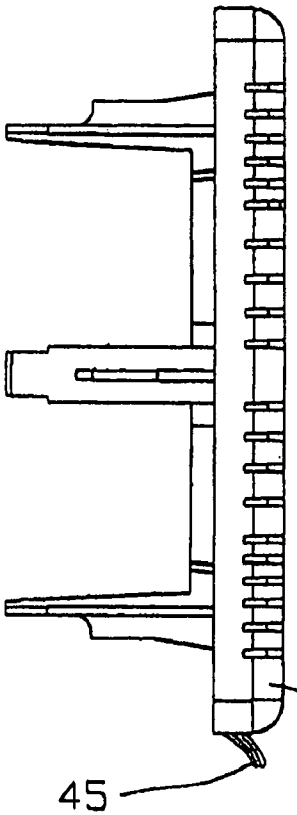

As shown in FIG. 4B, the rear of the faceplate 21 has support ribs (also known as support bars) 35 to strengthen the antivortex center support 20 to prevent crushing. Drain slots 34 on faceplate 21 allow water to drain back into the tub after shutdown as shown in FIG. 4B. A cavitation port fin 22 is located in at least four positions on the rear of faceplate 21. Providing multiple cavitation port fins 22 facilitates the mounting of the faceplate 21 on the housing 24. Because each cavitation fin 22 slidably fits into receiving slot 56 to cover the cavitation port hole 44, it would not be necessary to dictate a particular fin or particular orientation of the faceplate 21 to mount onto the housing 24. Magnets 26 hold faceplate 21 to the faceplate housing 24.

FIGS. 5A, 5B illustrate an embodiment of the suction filter core 2. Filter core 2 is attached to filter housing 31 (see FIG. 2) by male ridges 32B on housing 31, which fit into receiving slots 32A on filter core 2. The filter core 2 is preferably an ABS pipe mountable in filter housing 31. One embodiment of the filter core plastic is injected with antimicrobial additives during the injected molding process to inhibit any bacteria growth on the core.

The filter core holes and slots (together known as apertures 37) range from small 37A at the outlet end 36B to large 37B at the closed end opposite the outlet end 36B. The larger perforation sizes on the end opposite the outlet end 36B distribute the water flow across the entire length of the filter media 53,54. Without the enlarging feature of the varying apertures, the water would only be filtered by a small portion of the filter media 53,54 near the outlet 36B.

The filter core 2 has an antimicrobial chamber 38 that houses antimicrobial additives such as slow dissolving chlorine, bromine, or a variety of other antimicrobial additives. Antimicrobial chamber 38 has an adjusting bleeder hole opening 85 from which the additive exits into the water that can be increased or decreased by turning the main body of the antimicrobial chamber 38 in one direction or another, wherein the more the antimicrobial chamber is screwed on, the smaller the hole opening 85 becomes. Although the one feature of one embodiment antimicrobial chamber has one hole, multiple holes or slots can be used. In addition, the configuration, size, and location of the singular or multiples bleeder holes or slots may vary.

FIG. 5C is a top perspective view of another embodiment of the suction filter core 2 depicting multiple chambers therein. Alternate chambers 39B, 39C may be added on the filter core 2 along with antimicrobial chamber 39A for the addition of other additives such as ion exchange resins for water softening, fragrances, or the like. Chamber support 40 prevents crushing. The corresponding additives exit chambers 39A, 39B, and 39C into the water from bleeder holes 61, 62, 63. Additional alternate chambers may be included if desired.

As shown, the alternate embodiment antimicrobial chamber 39A is located furthest from the outlet end 36B. However, it may be configured at any location within filter core 2. Just as the feature of one embodiment of the antimicrobial chamber 38 may have multiple bleeder holes or slots of varying configurations, sizes, and locations, the embodiment having alternate chambers may include variations from which additives may exit or bleed from.

Figure 6A:
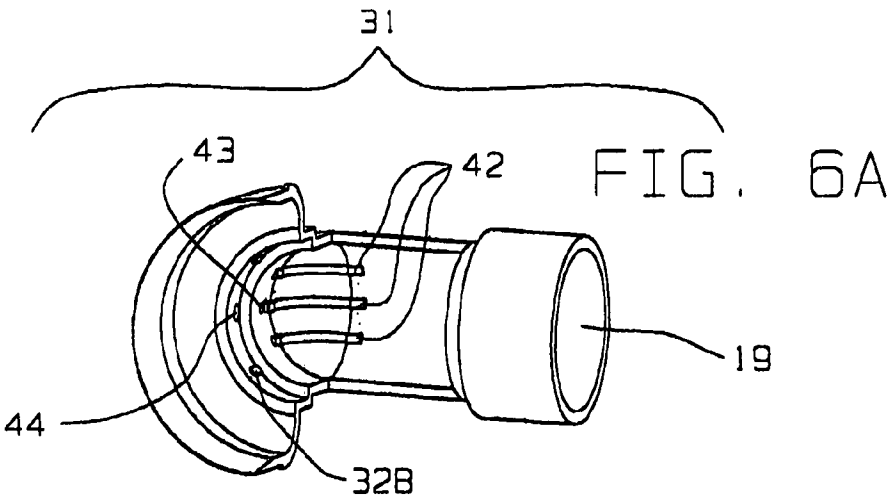
FIG. 6A is a cutaway plan view of the suction filter core housing shown in FIG. 2.
Figure 6B:
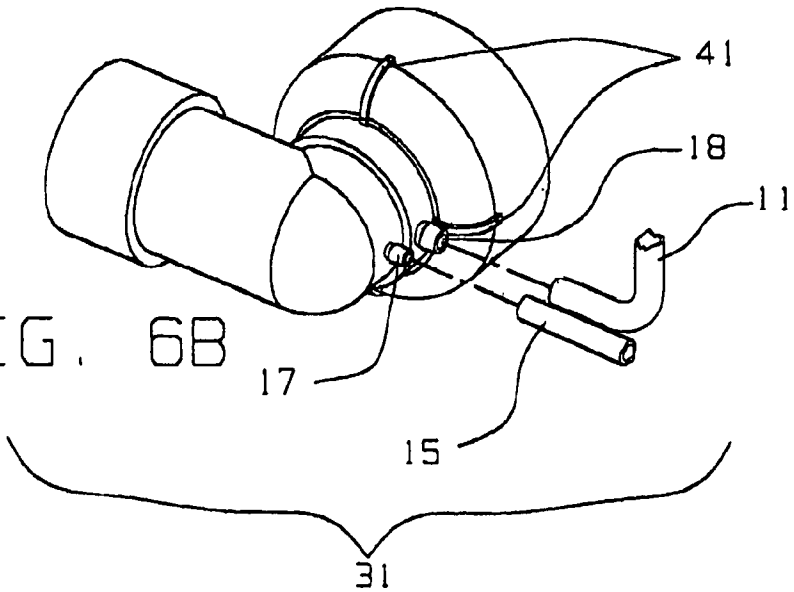
FIG. 6B is a rear plan view of the suction filter core housing showing a non-electric cavitation porthole.

Referring next to FIGS. 6A, 6B, and the rear portion 400 of filter housing 31 is curved at the top rear wall 80 and generally shaped like a half-cylinder when integrated with the bottom rear 81. The front portion of the elbow shaped filter housing 31 can be connected to a suction drain of a water circulation system that requires a relatively high rate of intake water flow. Housing 31 is readily installed into a standard size-opening cut or formed into the tub wall 6A (see FIG. 1). Housing stop 41 prevents the filter housing 31 from protruding too far past the inner tub wall 6A. Filter core 2 (see FIG. 5A, 5B, 5C) is attached to filter housing 31 by male ridges 32B on housing 31, which fit into receiving slots 32A on filter core 2. Water passes through filter core 2, bypasses the antivortex ridges 42 and through pump outlet 19, whereby the filtered water circulates back into the water vessel system.

As shown in FIG. 6B, antimicrobial additives enter the water system via antimicrobial line 15 connected to the additive port 17 through additive hole 43 (see FIG. 6A), which lies adjacent to the porthole for the filter sensing cavitation line 11. The filter sensing line 11 is connected to the filter cavitation port 18.

Figures 8, 8A, 8B, 8C, 8D:
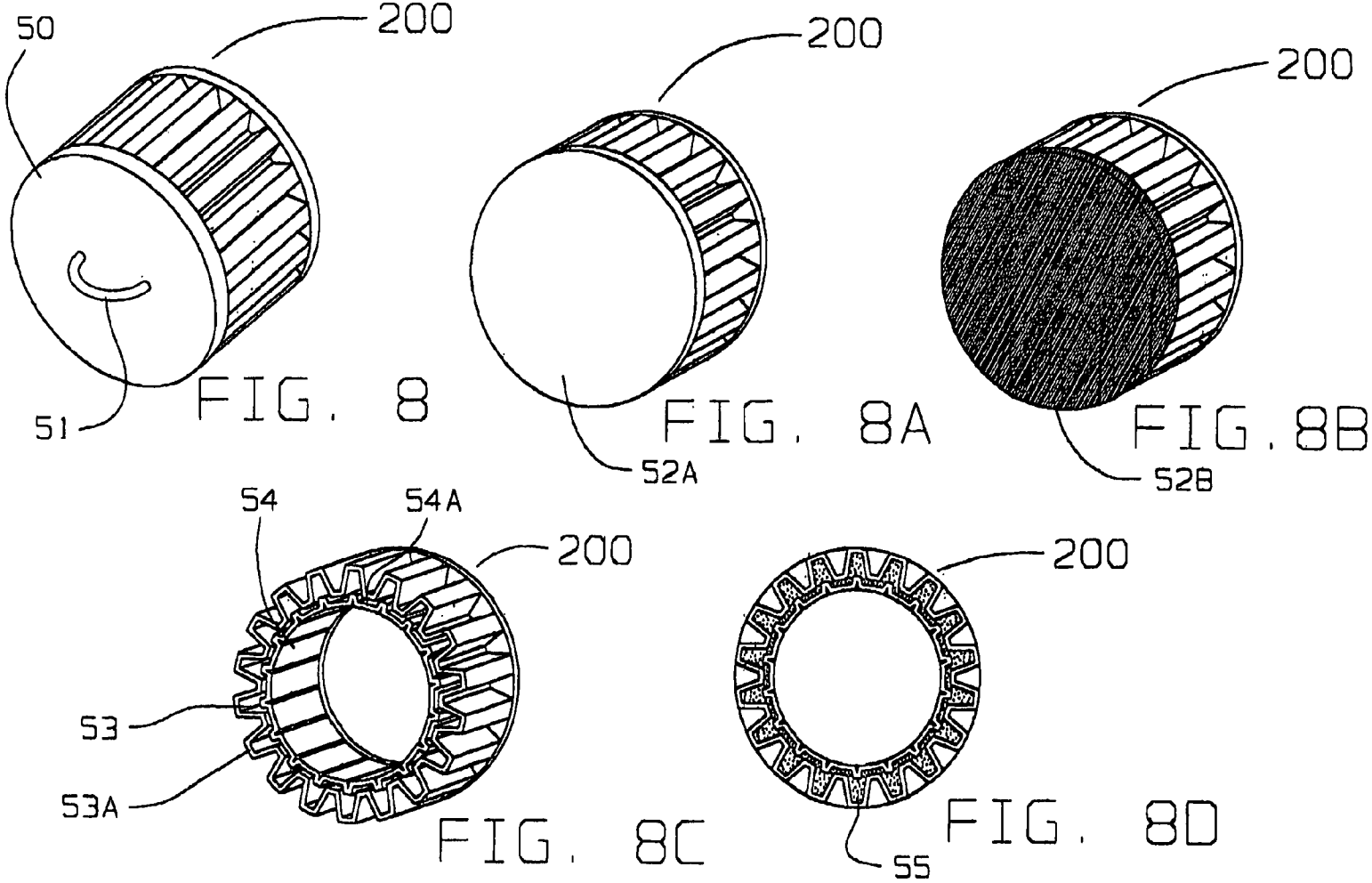
FIG. 8 is a top perspective view of a suction filter with end cap for the suction filter assembly.
FIG. 8A is a perspective view of another embodiment of the suction filter end cap depicting a first color indicator, wherein the first color indicates the usability of the filter.
FIG. 8B is a perspective view of the embodiment of FIG. 8A depicting a second color indicator, wherein the second color indicates the replaceability of the filter.
FIG. 8C is a rear perspective view of the FIG. 8 suction filter end cap.
FIG. 8D is a rear plan view of the FIG. 8 suction filter end cap.

FIG. 8 is a top perspective view of a suction filter 200 with end cap 50, preferably rubberized. Pull-tab 51 facilitates the removal of the filter 200.

The end cap embodiments of FIGS. 8A, 8B illustrate the use of color as an indicator for filter replacement. The first color 52A would indicate the filter is not ready for replacement. The second color 52B would indicate the filter should be replaced.

FIG. 8C is a rear perspective view of the FIG. 8 suction filter end cap showing an embodiment with a two stage pleat filter media having outer filter media chamber 53 and inner filter media chamber 54. Outer pleat 53A of outer chamber 53 has larger pleat holes, which allow larger sized particles and debris to pass through its antimicrobial treated filter pleat. Inner pleat 54A of inner chamber 54 has smaller openings, which allow only microscopic debris particles to pass through its treated filter pleat. The inner chamber's pleat media 54A captures the particles, which pass through the outer chamber pleat media 53A. Preferably the outer and inner filter media is polypropylene or other media that will accept antimicrobial agents.

In FIG. 8D, debris 55 is shown captured in the spaces between the inner and outer pleats. However, since outer media 53A and inner media 54A are impregnated with antimicrobial agents, any accumulation of bacteria in debris 55 would be killed by the antimicrobial effects.

Figure 9:
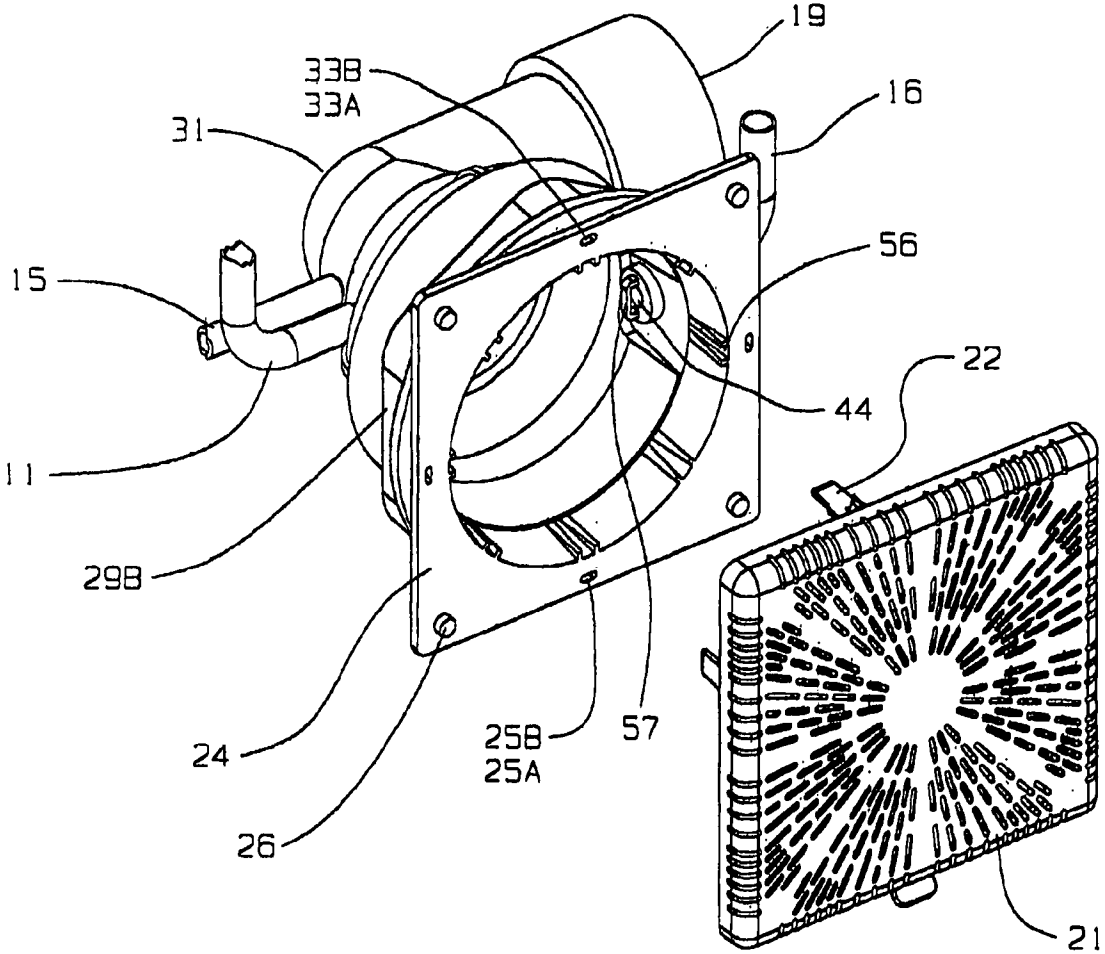
FIG. 9 is a top perspective view of the housing and faceplate design for a suction filter apparatus.

FIG. 9 is a top perspective view of the housing and faceplate design for a suction filter apparatus. In fact, FIG. 9 shows how the exploded components shown in FIG. 2 are assembled. The faceplate housing 24 is attached to the inside surface of tub wall 6A (not shown) wherein the female fittings 25A, 33B on faceplate housing 24 receive the male end 25B, 33A on gasket 28 (see FIG. 2). The housing 24 is secured in placed by nut 29B on the outer surface (back side) of the tub wall 6A. The appropriate cavitation port fin 22 (see FIGS. 10, 11) extends from faceplate 21 and slidably fits into receiving notch 56 through receiving bracket 57 to cover the cavitation porthole 44. Magnets 26 hold faceplate 21 to the faceplate housing 24.

Figure 11:
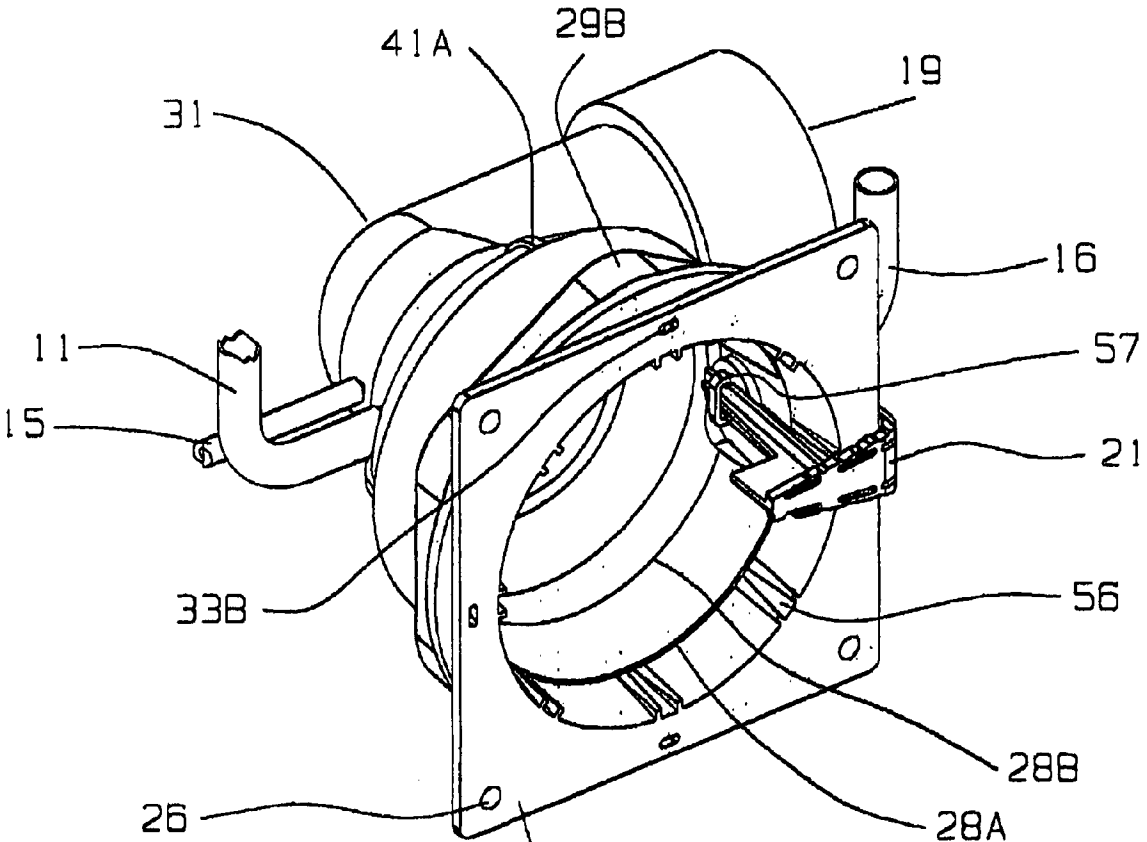
FIG. 11 is the same view as FIG. 9 with an embodiment of a faceplate fin shown inserted into a receiving bracket of the suction filter core housing, thereby enabling a seal over the non-electric cavitation porthole.

FIG. 11 is the same view as FIG. 9 with a cutaway view of faceplate 21 exposing cavitation port fin 22. Cavitation port fin 22 is shown inserted into receiving bracket 57 of filter housing 31, thereby enabling a seal over the non-electric cavitation porthole 44. Faceplate housing 24 has a sloped taper 28B (high end) to 28A (low end) to allow water to drain back into the tub after shutdown.

Figure 12:
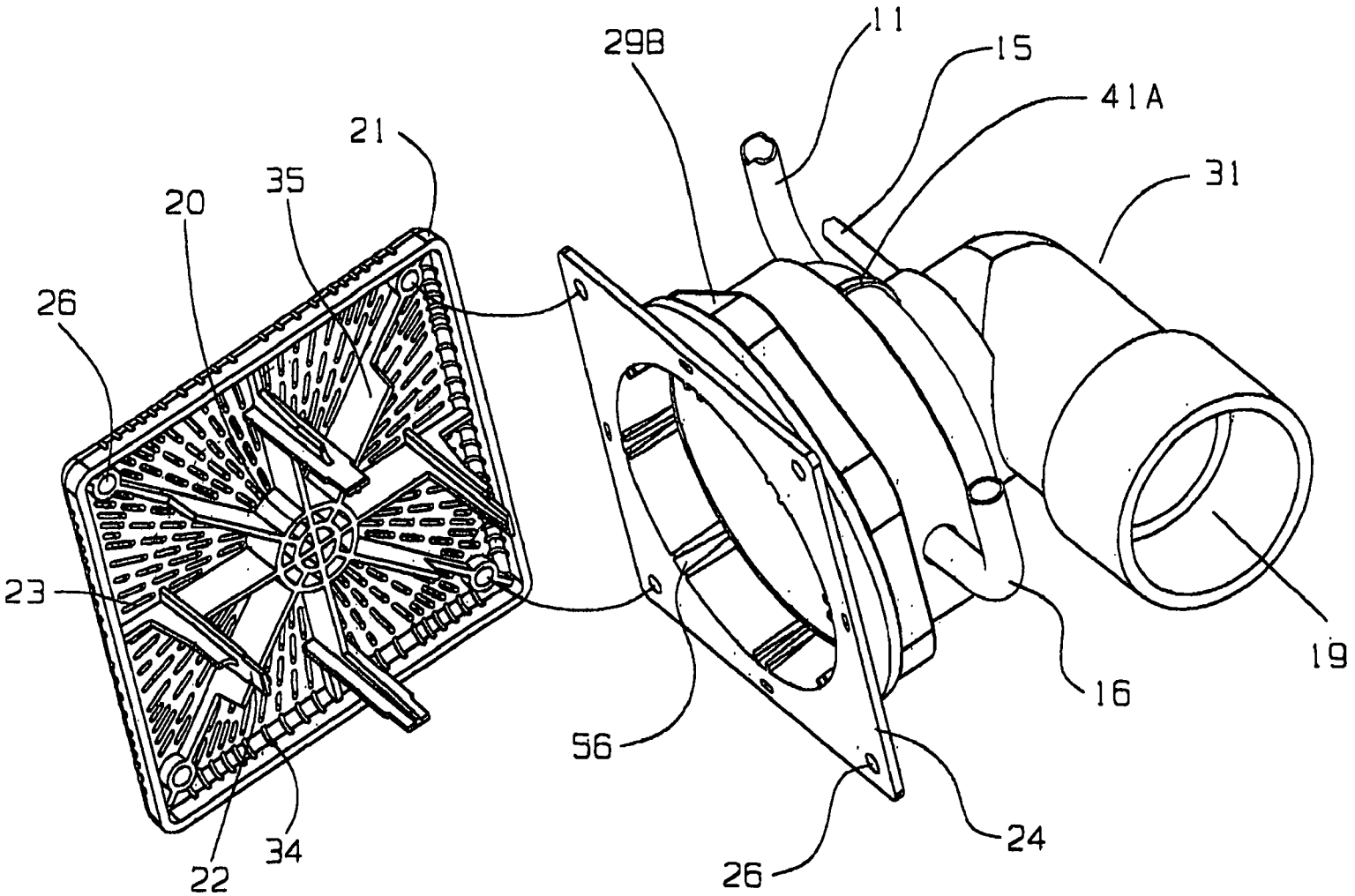
FIG. 12 is a top perspective exploded view of an embodiment of the faceplate housing and faceplate design for a suction filter apparatus.

FIG. 12 is similar to FIG. 9. Where FIG. 9 depicts the front side of faceplate 21, whereby magnets 26 attach the faceplate 21 to housing 24, FIG. 12 depicts the rear side of faceplate 21.

Figure 10:
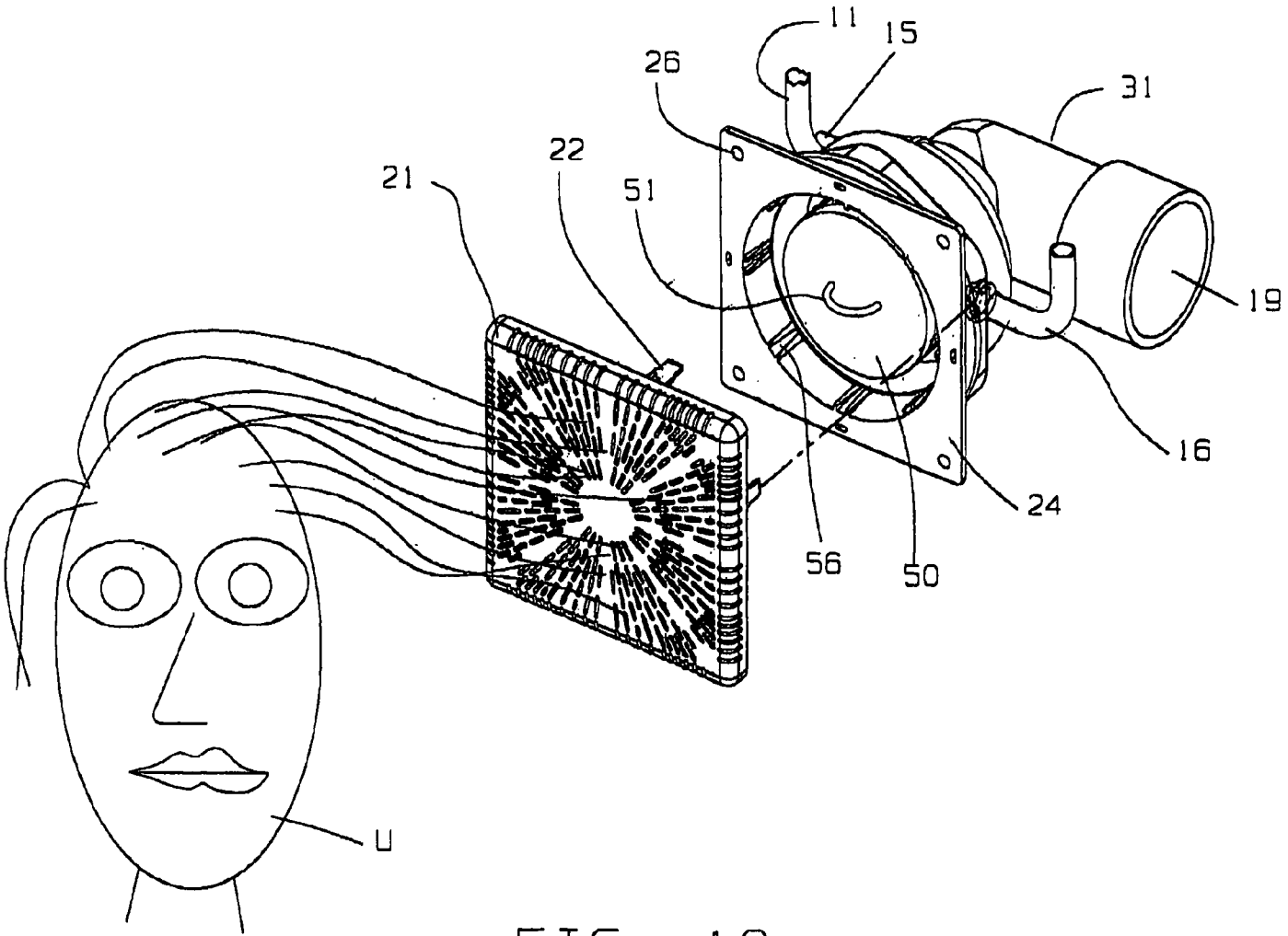
FIG. 10 is an top perspective exploded view of a user getting her hair entrapped in an embodiment of the faceplate/housing design, wherein only the magnets hold the faceplate to the housing, and an end cap with pull tab design, thereby enabling a safety oriented pop off faceplate and pull out filter.

FIG. 10 is an top perspective exploded view of a user U getting her hair entrapped in an embodiment of the faceplate 21/housing 24 design, wherein only the magnets 26 hold the faceplate 21 to the housing 24, thereby enabling a safety pop off design. Pulling the faceplate 21 out will cause the cavitation port fin 22 to slidably detach from receiving notch 56 and expose cavitation porthole 44 to air. Once air from the faceplate sensing cavitation line 16 is drawn into the pump 3, pump 3 would cavitate. Therefore, pump cavitation is triggered when the faceplate sensing cavitation line 16 detects a missing or broken faceplate 21.

Likewise, when filter-sensing line 11 detects a missing filter, pump cavitation occurs. User U can easily remove the filter assembly by using the end cap pull tab 51 to pull the end cap 50 and filter 200 out, thereby causing pump cavitation. The filter sensing line 11 is connected to the filter cavitation port 18 (see FIGS. 6A, 6B).

Figure 13:
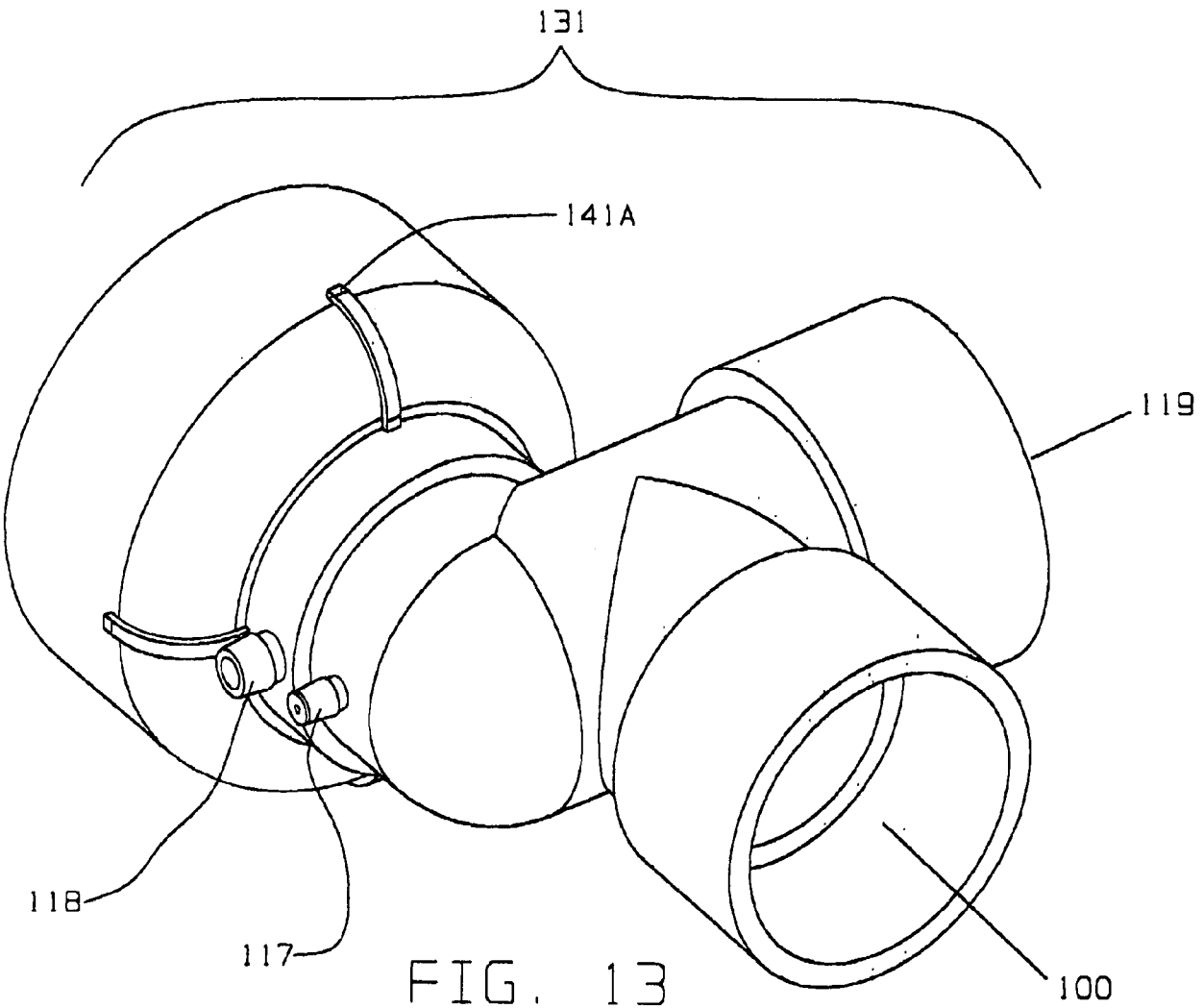
FIG. 13 is a rear perspective view of one embodiment of the housing for a suction filter apparatus showing a skimmer outlet and a pump outlet.

FIG. 13 is a rear perspective view of another embodiment of the housing for a suction filter apparatus showing skimmer outlet 100 and pump outlet 119. Although spas also have skimmer filters that draw surface water through the filters into a pump and back through the jets, the majority of the water passing through other suction points bypasses the skimmer filters. The alternate embodiment orifice 131 can be hooked up in tandem to a skimmer filter in a spa to filter water that bypasses the skimmer filter. Antimicrobial additives enter the water system via the additive port 117 adjacent to the filter cavitation port 118.

Figure 16:
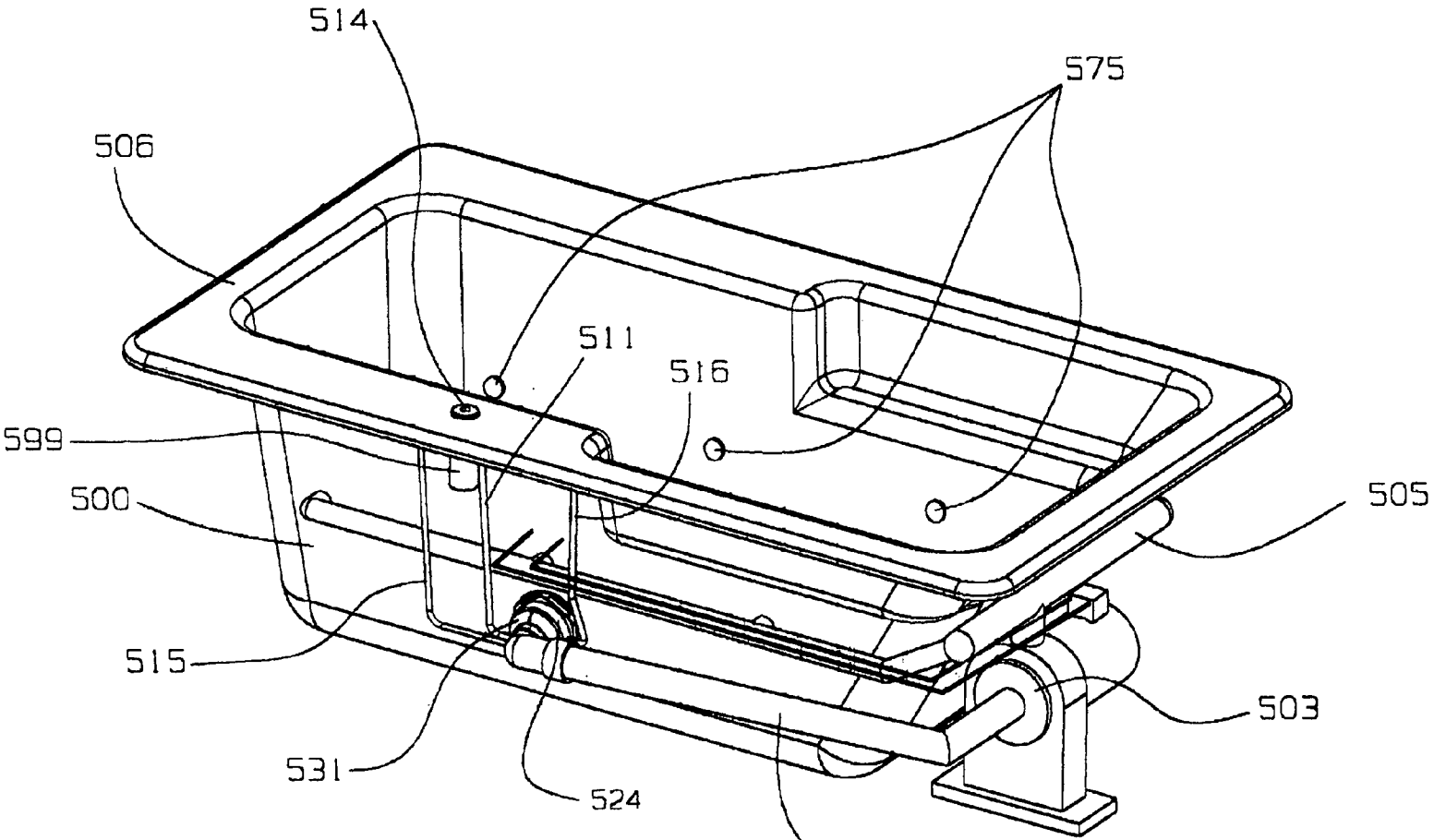
FIG. 16 is a top perspective view of an alternate embodiment of one embodiment of the present invention, wherein each water vessel component is impregnated with antimicrobial additives creating a total water vessel sanitation system.

FIG. 16 is a top perspective view of features of one embodiment of the present invention, wherein each water vessel component is impregnated with antimicrobial additives creating a total water vessel sanitation system. One embodiment of the total water vessel sanitation system uses components that have been manufactured using antimicrobial additives including but not limited to the fiberglass/resin vessel backing 500, acrylic sheet 506, pump 503, jets 575, inlet pipe 504, outlet pipe 505. A feature of one embodiment of the present invention is the treated filter sensing cavitation line 511 and treated faceplate sensing cavitation line 516 extend from treated suction filter housing 531. As even the antimicrobial system components are treated, injector button 514 is depressed to activate the antimicrobial additives dispenser 599 that delivers antimicrobial additives to the water vessel covered by acrylic sheet 506 via antimicrobial line 515. FIG. 16 is not shown to have a filter. One embodiment of the present invention is impregnated with at least one of the components of a non-leaching antimicrobial agent selected from the group consisting of 2,4,4-trichloro-2-hydroxy diphenol ether and 5-chloro-2phenol (2,4 dichlorophenoxy) compounds see U.S. Pat. No. 6,540,916 (2003) to Patil (assigned to Microban Products Company, Huntersville, N.C.) at column 3, line 30.

Inlet pipe 504 cants downward from pump 503 to suction filter housing fitting 531.

Figure 23:
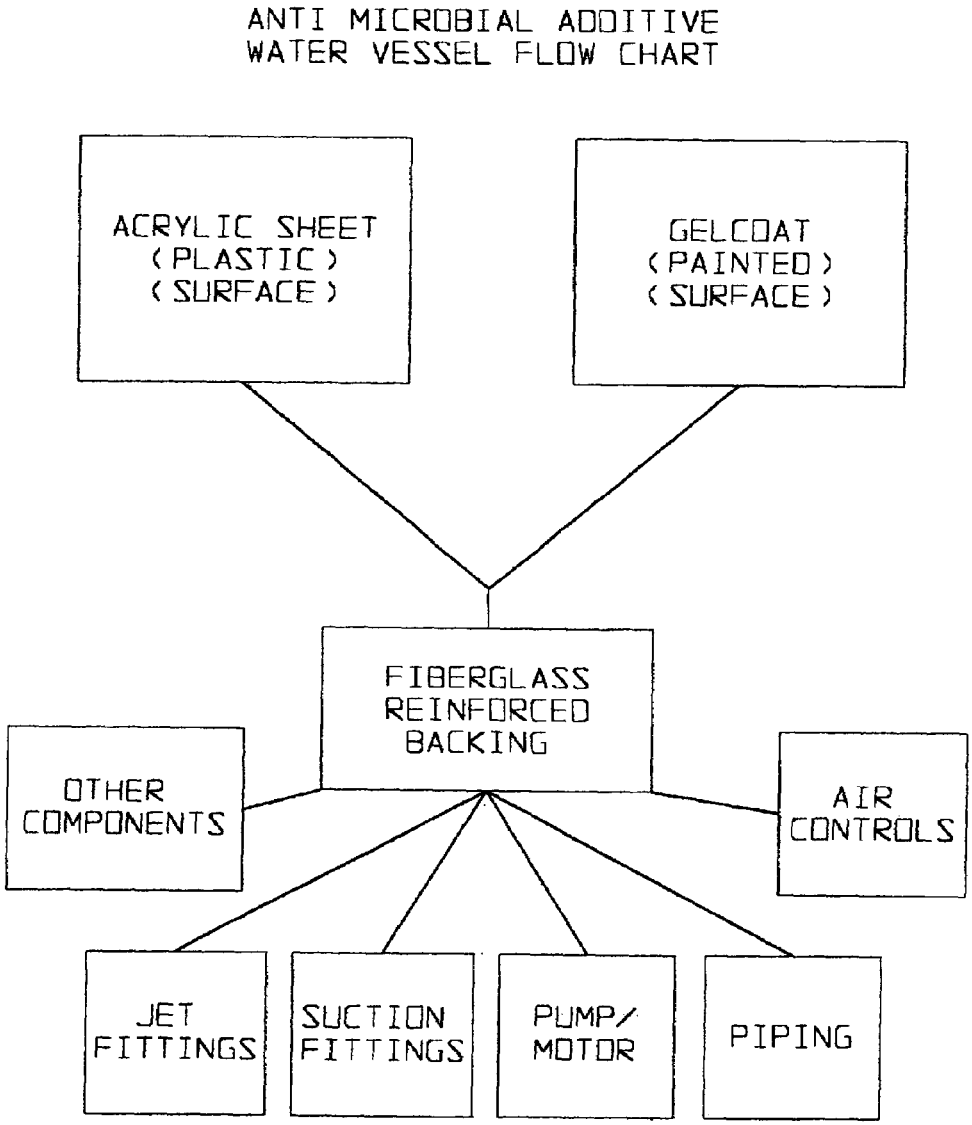
FIG. 23 is a flow chart illustration of a one embodiment of total water vessel sanitation system that includes antimicrobial additives in each component of the water vessel.

FIG. 23 presents a flow chart illustration of one embodiment of a total water vessel sanitation system, of FIG. 16, FIG. 16 and FIG. 23 represents features of one embodiment of the present invention. Antimicrobial additives may be added to each component of the water vessel to provide for optimum bacteria reduction in a water vessel system. The acrylic sheet or gelcoat surface may be treated at point of manufacture. In addition, fiberglass reinforced backing, air controls, jet fittings, suction fittings, pump, motor, piping and other components may treated with antimicrobial additives to provide for optimum protection from bacteria.

Figure 17:
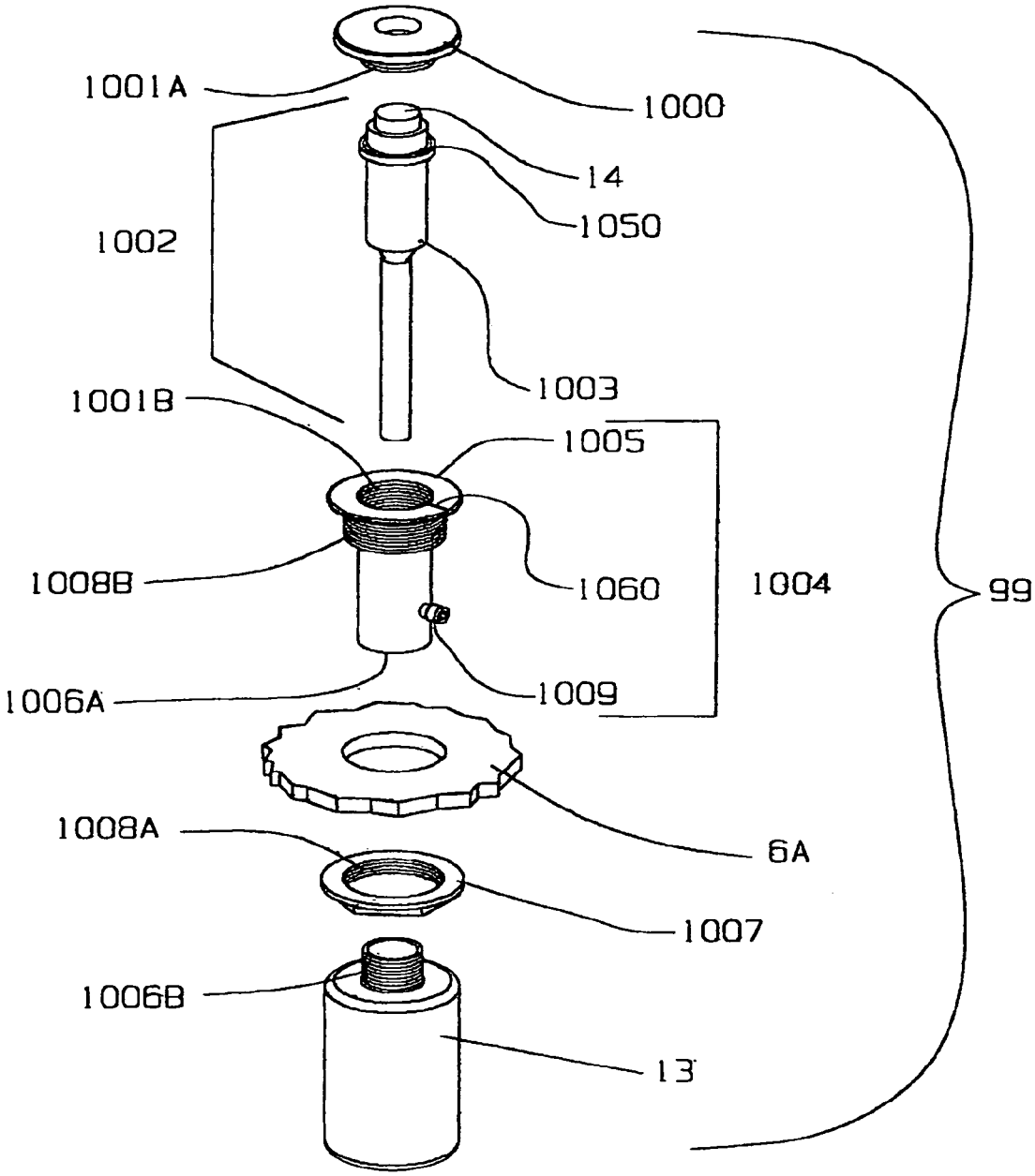
FIG. 17 is a plan exploded view of one embodiment of an injector button assembly for dispensing antimicrobial agents.

FIG. 17 is a plan exploded view of one embodiment of one feature of the present invention, an injector button assembly for dispensing antimicrobial agents. Antimicrobial dispenser 99 is a deck mount top fill design. Injector assembly housing 1004 is fitted into the deck wall 6A of a tub through a standard size-opening cut. Flange nut 1007 having flange nut threads 1008A is mounted onto antimicrobial reservoir 13 positioned on the underside of the deck of the tub wall 6A. Inner tube injector assembly threads 1006A secure reservoir 13 under tub wall 6A by way of reservoir threads 1006B while flange nut threads 1008A secure injector assembly housing 1004 by threading into its outer assembly housing threads 1008B. Inner tube injector port 1009 is thus located on the underside of the deck of the tub wall 6A. Sub-assembly 1002 is inserted into the open end of injector assembly housing 1004 atop the deck of tub wall 6A, wherein the antimicrobial pick up tube resides within reservoir 13 and sub-assembly injector port 1003 aligns with inner tube injector port 1009 by means of aligning line 1050 on the pick up housing 2004 of sub-assembly 1002 with line 1060 on injector assembly housing flange 1005. Button cover 1000 having button cover threads 1001A is mounted through its center hole over sub-assembly 1002 onto injector assembly housing flange 1005 and tightened by screwing button cover threads 1001A into assembly housing threads 1001B within inner assembly housing 1004. Button cover 1000 and injector button 14 are exposed at the deck of tub wall 6A (see FIG. 1).

Figure 18:
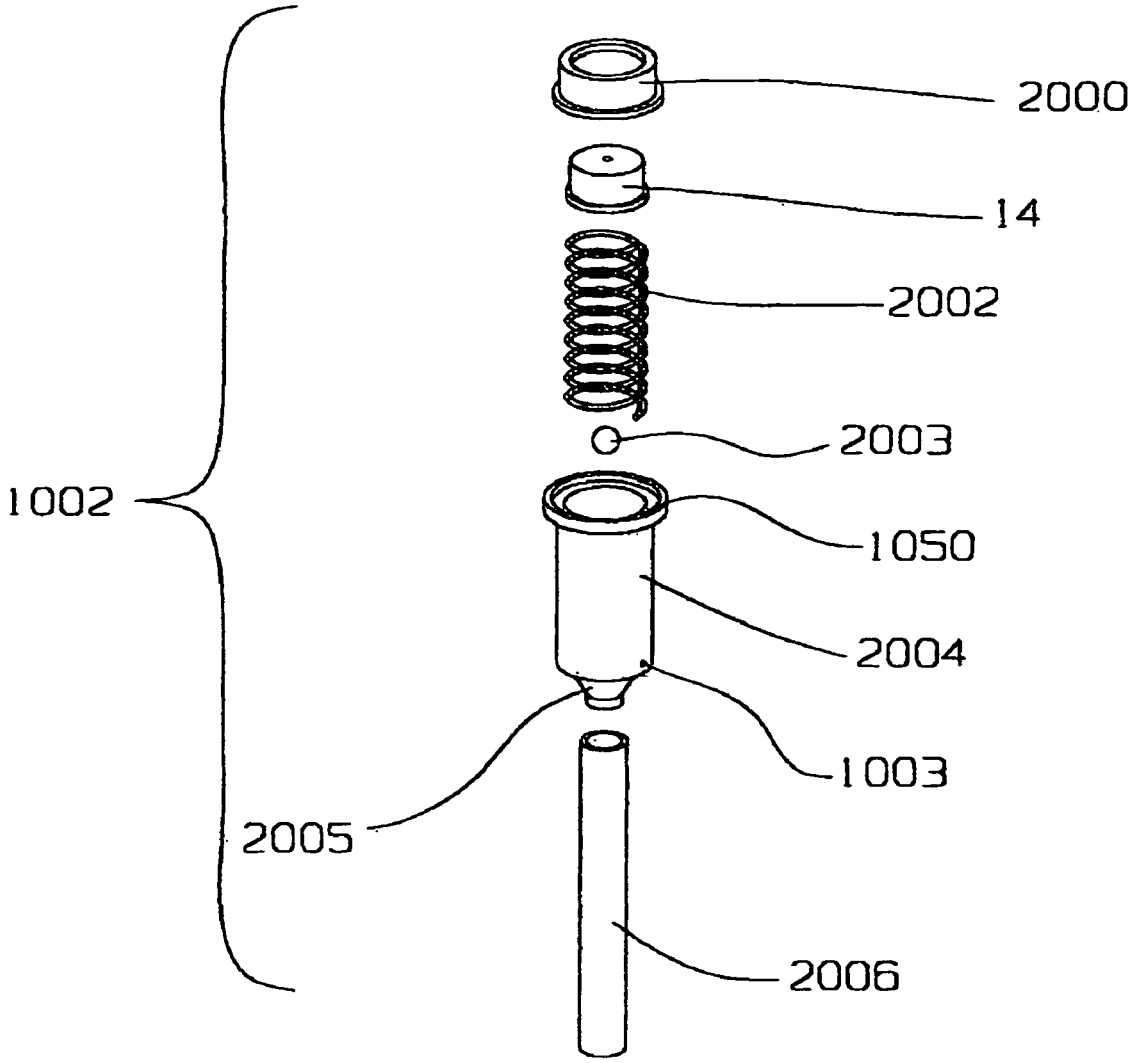
FIG. 18 is a plan exploded view of one embodiment of the injector sub-assembly shown in FIG. 17.

FIG. 18 is a plan exploded view of one embodiment of the injector sub-assembly 1002 shown in FIG. 17. Button retainer 2000 fits over injector button 14. Spring 2002 and check ball 2003 reside within pick up housing 2004 having an open end and a tapered check ball seat 2005. Sub-assembly injector port 1003 is located on pick up housing 2004 adjacent to check ball seat 2005. Antimicrobial pick up tube 2006 fits into the tapered end of pick up housing 2004 abutting check ball seat 2005. Upon assembly, sub-assembly 1002 is inserted into the open end of injector assembly housing 1004 atop the deck of tub wall 6A (see FIG. 17).

Figure 19:
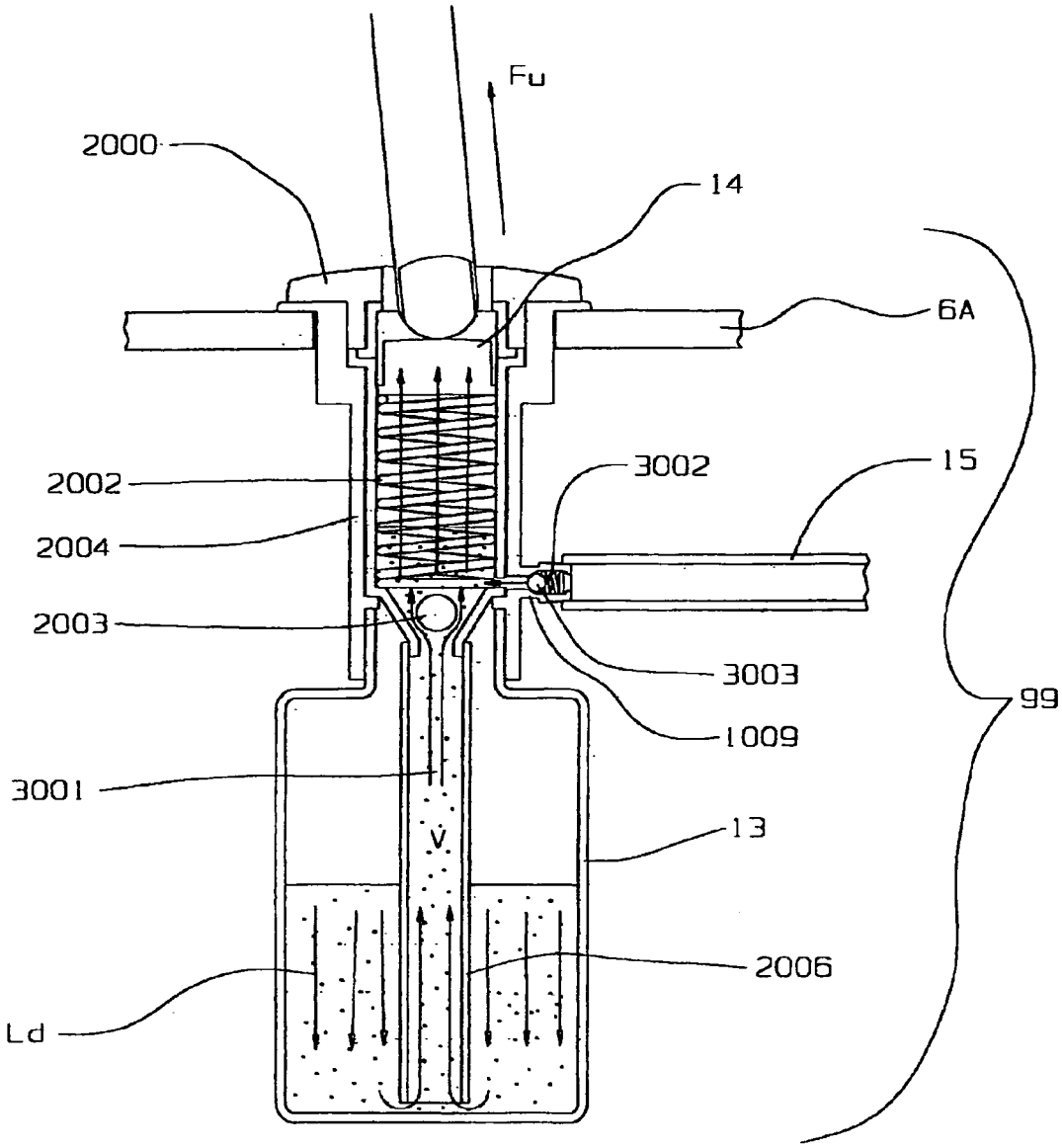
FIG. 19 is a longitudinal sectional view of the deck mount top fill dispenser of FIG. 17 is one embodiment of an antimicrobial liquid reservoir.

FIG. 19 is a longitudinal sectional view of the deck mount top fill dispenser 99.

FIG. 17 shows a feature of one embodiment of the present invention, an antimicrobial liquid reservoir 13. FIG. 19 shows that initially there is no antimicrobial liquid 3001 in antimicrobial line 15 connected to inner tube injector port 1009. As user depresses injector button 14 in direction F.sub.d (See (FIG. 20), spring 2002 within pick up housing 2004 compresses in direction P.sub.d. FIG. 19 shows that as user releases injector button 14 in direction F.sub.u, spring 2002 expands unseating check ball 2003 and causing vacuum V to draw antimicrobial liquid 3001 into antimicrobial pick up tube 2006. As vacuum V draws antimicrobial liquid 3001 up around check ball 2003, antimicrobial liquid 3001 within reservoir 13 moves in direction L.sub.d. A second check ball 3003 and spring 3002 reside within inner tube injector port 1009 (see also FIGS. 21, 22, 22A) preventing antimicrobial liquid 3001 from entering antimicrobial line 15.

Figure 20:
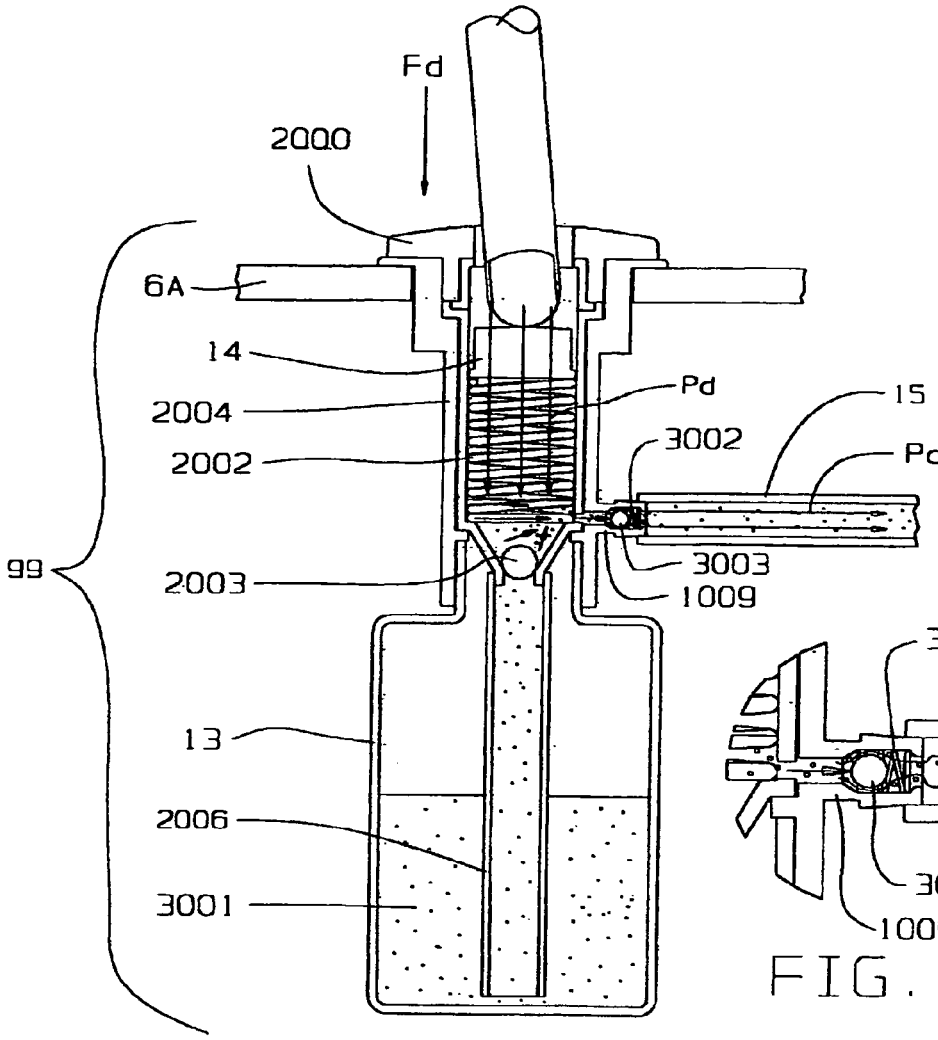
FIG. 20 is the same view as FIG. 19, wherein the injector button is depressed and antimicrobial liquid is dispensed into the water vessel system.

FIG. 20 is the same view as FIG. 19, wherein the injector button is depressed, thereby causing antimicrobial liquid 3001 entering antimicrobial line 15 to be dispensed into the water vessel system.

Figure 21:
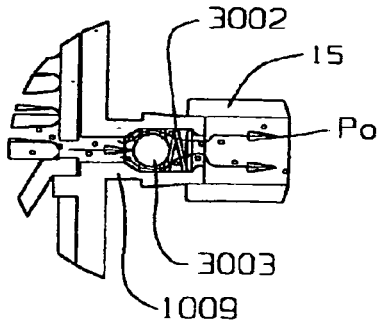
FIG. 21 is a close up plan view of the liquid pressure directing assembly of the dispenser for antimicrobial liquids shown in FIG. 20.

As user depresses injector button 14 in direction F.sub.d, spring 2002 within pick up housing 2004 compresses in direction Pd. Check ball 2003 reseats and holds antimicrobial liquid 3001 in reservoir 13 and antimicrobial pick up tube 2006 while spring 3002 compresses unseating check ball 3003. Antimicrobial liquid 3001, which was drawn past check ball 2003 as shown in FIG. 19, may now move past check ball 3003 in direction P.sub.o to enter antimicrobial line 15 to be dispensed in the water vessel system. FIG. 21 provides a close up view of the antimicrobial liquid movement into antimicrobial line 15 as shown in FIG. 20.

Figures 22, 22A, 22B:
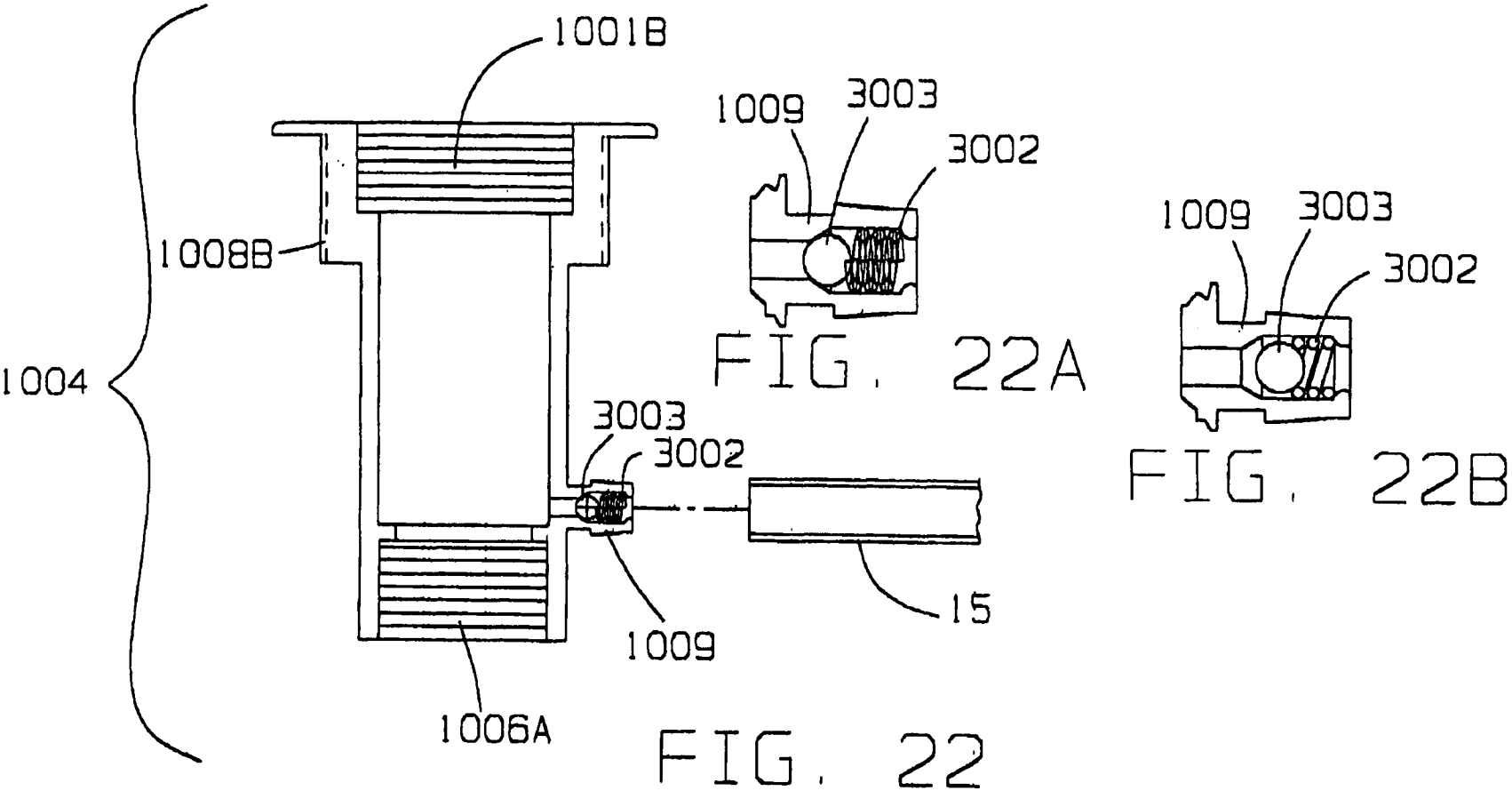
FIG. 22 is a sectional view of the injector assembly housing shown in FIG. 17.
FIG. 22A is a close up sectional view of the inner tube injector port with the port closed.
FIG. 22B is a close up sectional view of the inner tube injector port with the port open, thereby allowing antimicrobial liquids to enter the water vessel system.

FIGS. 22, 22A, 22B show the inner tube injector port 1009 of injector assembly housing 1004 to which antimicrobial line 15 is connected. Check ball 3003 and spring 3002 residing within inner tube injector port 1009 prevents antimicrobial liquid 3001 from entering antimicrobial line 15 when the port 1009 is "closed." The injector port 1009 is closed when check ball 3003 is seated as shown in FIG. 22A. When the injector port 1009 is "open," antimicrobial liquid 3001 may enter antimicrobial line 15. The injector port 1009 is open when check ball 3003 is unseated as shown in FIG. 22B.

Referring now more particularly to the drawings, in FIG. 1P is illustrated and new and improved hydromassage apparatus for a whirlpool bath system constructed in accordance with the features of the present invention and referred to generally by the reference numeral 20. The system is adapted for application with a tub of almost any design or other types of water holding receptacles and by way of illustration, a tube 22 may include a bottom wall 24, a pair of integral sidewalls 26, a pair of front and rear end walls 28 and a generally horizontal, integrally formed peripheral flange 30 extending outwardly around the upper edges of the respective side and end walls of the tub. The tub may include a removable, outer sidewall (not shown), which encloses and covers one side of a peripheral access space to the system components around the outside of the respective end and sidewalls. The operating components and plumbing for the hydromassage apparatus are contained in this space and are hidden from view when the outer sidewall is in place.

Water for use in the hydromassage provided by the whirlpool bath system is supplied to the tub and is drainable therefrom in a conventional manner and the temperature of the water is usually selectively controlled as the tub is being filled, although auxiliary heaters may be provided.

The system includes a water-circulating pump 32 driven by an electric motor 34, both of which are mounted on a base plate 36 secured to an underlying supporting floor or other surface at the rear end of the tub below the flange 30 or at other convenient location. The pump includes a suction inlet 32*a* which is supplied with water from the tub through an inlet supply conduit 38 connected to a suction box 40 shown in enlarged detail in FIGS. 10P and 11P and which may be mounted at any convenient location such as on the sidewall 26 at a lower level adjacent the forward end. A pressure outlet 32*b* of the pump is connected via a short conduit 42 to a dividing tee 44 having opposite branches connected to a pair of pressure conduits 46 extending longitudinally of the tub sidewalls 26 beneath the horizontal side flanges 30. These conduits supply water to a pair of tee fittings 48 having opposite outlet branches connected to the inlet end of a pair of air injectors 50 which are shown in enlarged detail in FIGS. 2P, 3P and 3AP and which are constructed in accordance with the features of the present invention.

The outlet end of each air injector may be connected via a conduit 52 to an elbow 54 or directly to an elbow, depending on the tub design, in order to supply a flow of high velocity, aerated water to one or more nozzle assemblies 60 which are constructed in accordance with the features of the present invention and which are shown in greater detail in FIGS. 7P, 8P and 9P. In the illustrated embodiment, a pair of nozzle assemblies 60 is mounted on each of the tub sidewalls 26 at an appropriate level therein and it is to be understood that additional nozzle assemblies can be included if desired, or a lesser number of nozzle assemblies may also be provided depending upon the size of the tub or receptacle involved and the particular type of hydromassage installation.

When desired, ambient outside air may be supplied to the air injectors 50 through air supply hoses 56 which are interconnected and supplied by a common branch conduit 58 mounted on each side of the tub beneath the flange 30. These conduits are interconnected to the outlets of a manually controllable, air inlet and safety valve 70 which is constructed in accordance with the features of the present invention and which is mounted at a convenient location for ready manipulation on the upper, horizontal flange 30 of the tub at the head end.

Referring now more particularly to FIGS. 10P and 11P, the suction box 40 includes a hollow body 62 preferably formed of molded resinous plastic material which is light in weight, strong and resistant to corrosion and the accumulation of scale thereon. The body 62 includes an open circular inlet end portion 62*a* which is seated in a circular opening 26*a* formed in one of the tub side walls. The body includes an outlet section 62*b* of circular transverse cross-section having a diameter somewhat less than that of the inlet end section. The outlet section extends at right angles to the axis of the inlet section and is connected to the inlet conduit 38 leading to the inlet 32*a* of the pump 32.

The body 62 is formed with a radial mounting flange 62*c* adapted to abut the surface of the tub wall 26 around the opening 26*a* and is sealed against the tub wall by means of sealant material 64. The suction box housing is secured in place on the tub wall by a plurality of fasteners 66 in the form of headed cap screws which may be formed of plastic or non-corrosive metal and including washers and nuts threaded onto the shank of the cap screws adjacent the back face of the flange 62*c*. The fasteners 66 are located at circumferentially spaced positions on the flange and the shanks pass through openings 26*b* formed in the tub wall and aligned openings 63 formed in the flange 62*c* of the suction box body.

On the inside surface of the tub wall 26, the suction box is provided with a circular, grill ring 68 having an outer annular rim portion 68*a* and a central portion with a plurality of integrally formed, transversely intersecting ribs 68*b* forming a grill or screen for preventing objects of relatively large size from passing into the hollow suction body 62. On the inner face, the rim 68*a* is formed with a plurality of, relatively large, arcuately shaped recesses 69 for lightening the weight and conserving material and at diametrically opposed positions adjacent the headed fasteners 66, a plurality of smaller, arcuately shaped recesses are formed to receive the heads of the cap screws as shown in FIGS. 10P and 11P.

The inlet grill ring 68 is secured in place by a plurality of self-tapping, countersink head, screw fasteners 72 positioned at diametrically opposed points around the outer rim 68*a* radially spaced from the cap screw fasteners 66. The shanks of the fasteners 72 extend through openings 26*b* in the tub walls to tap into thickened portions of the flange 62*c* on the suction box body 62 as shown. Should the ribs 68*b* become damaged or broken, necessitating replacement of the inlet grill 68, it is a relatively simple matter to remove the screw fasteners 72 and subsequently replace the ring. This is done without requiring removal or detachment of the suction box body 62 from the tub wall 26. The ribs 68*b* may be of alternately varying thickness as shown to help prevent suction obstruction.

Referring now to FIGS. 2P, 3P and 3AP, the air injector 50 is of the venturi-action type and is adapted to provide a high velocity jet stream of turbulent, aerated water for the hydromassage apparatus. The air injector includes a generally cylindrical, elongated hollow body 74 preferably formed of molded resinous plastic material and formed with an open ended inlet section 76 having a diameter slightly larger than an intermediate section 78 which forms the outer wall of an annular air chamber 80.

The air chamber annulus is supplied with air from the conduit 56 which is attached to a radially outwardly extending inlet fitting 82 on the intermediate section 78 and the fitting is formed with ridges and grooves on the outer surface thereof in order to tightly seal with the end of the hose conduit in an air tight connection. The elongated body also includes a nozzle outlet section 84 having an open outer end portion provided with an annular groove therein to lighten the weight and conserve expensive material. The outlet section 84 tapers from a minimum diameter inlet end 84*a* spaced inwardly of the annular air chamber 80 and forming a forward portion of the inner wall thereof to a maximum diameter outer end portion 84*b* connected to the conduit 52. The outlet section 84 provides an expanding nozzle for the turbulent, aerated flow of air and water mixture formed in the air injector 50.

In accordance with the present invention, the air injector includes a nozzle insert 86 having an annular, outwardly extending radial flange 86*a* which is seated against a recess or shoulder formed at the junction between the inlet section 76 and the smaller diameter intermediate wall section 78. The nozzle insert includes an annular, generally cylindrical intermediate skirt wall 86*b* forming a rear segment of an inner wall for the annular air chamber 80. The forward end of the skirt wall 86*b* terminates upstream of and is spaced from the inner end 84*a* of the outlet nozzle section 84 as shown in FIG. 2P. The nozzle insert also includes an annular, front end wall 86*c* integrally joined with the cylindrical skirt wall 86*b* at the forward end with a rounded transition portion as shown. The radial end wall 86*c* is formed with an enlarged circular opening 87 having a diameter slightly less than the inside diameter of the inner end 84*a* of the outlet nozzle section 84. Upstream of the radial, annular front end wall 86*c*, the nozzle insert is formed with a radially disposed annular wall segment 86*d* integrally secured to the skirt wall 86*b* by a pair of diametrically opposed radial arm segments 86*e* as best shown in FIG. 3AP. The segment 86*d* is formed with a centrally disposed, circular passage 89 which defines a center nozzle orifice that forms a primary, high velocity jet stream of water which flows axially along the longitudinal axis of the air injector.

Between the small diameter passage or opening 89 and the larger opening 87 at the front end of the nozzle insert, there is provided an inner, annular cylindrical skirt wall 86*f* of intermediate diameter and this arrangement provides for a stepped diameter orifice structure having three segments of increasing diameter in a direction downstream of the first, small diameter opening 89. The nozzle insert 86 is formed with a plurality of outer, secondary passages 91 which direct secondary jet streams of water from a position outwardly around the inside surface of the skirt wall 86*b* inwardly toward the center axis to angularly intersect the flow axis of the primary jet stream of water flowing through the stepped diameter passages of the nozzle insert. This arrangement provides for high turbulence in the area and this turbulent flow is highly efficient in mixing air and water and drawing air by venturi-action into the water streams from an annular open space 90 formed between the radial end or front wall 86*c* of the nozzle insert and the inlet end 84*a* of the outlet nozzle section 84 of the air injector.

The air injectors 50 provide a highly efficient turbulent mixing and venturi-type suction action to induce air flow into the primary and secondary convergent water streams and this aerated mixture is carried to the respective nozzle assemblies 60 mounted on the side walls 26 of the tub or receptacle 22 to provide hydromassage action. Preferably, the separate nozzle inserts 86 are formed of molded resinous plastic material as in the body 74 of each air injector. The high velocity turbulent fluid stream of air and water from each of the air injectors is directed via the elbows 54 to the inlet side of the respective adjustable nozzle assemblies 60 on the tub walls 26.

Each nozzle assembly includes a hollow body 92 having an inlet end 92*a* in communication with the outlet of a tee 54 and an outlet end 92*b* mounted to extend into a circular opening 26*c* formed in the tub wall at the desired location. The body also includes an integrally formed, radially outwardly extending annular flange 92*c* having a planar face adapted to be sealed against the back face of the tub wall around the circular opening 26*c* by sealing material 94. The body flange 92*c* is secured to the tub wall by means of a circular shaped, annular flange ring 96 mounted adjacent the tub wall and secured with the flange 92*c* of the body by a plurality of cap screw type fasteners 98 having threaded shanks which project into threaded inserts provided in circular bosses 96*a* These bosses have axial bores on the backside for receiving the fastener shanks and are dimensioned to extend through respective openings 26*d* formed in the wall 26 of the tub in a ring around the large diameter, central opening 26*c*.

Each nozzle assembly 60 includeds a manually controllable, nozzle outlet element 100 having a circular base flange 100*a* formed at the inlet end and mounted to rotate within a large, centrally disposed, circular opening 101 defined in the retaining ring 96. The nozzle element 100 includes an outlet end 100*b* which is open and lies on a plane angularly disposed in relation to a longitudinal flow axis of the body 92. Accordingly, the fluid stream of air and water mixture discharged from the outlet end of the nozzle element is directed with an angular component dependent upon the relative rotational position of the nozzle element in the retaining ring 96. An integral, transverse rib 100*c* is formed to extend transversely across the outlet end of the nozzle element and this rib aids in directionalizing the aerated fluid stream from the nozzle assembly.

Referring now more particularly to FIGS. 7P and 8P, the annular retaining ring 96 is formed with an upper, overhanging, arcuate rib 96*b* for retaining an upper portion of the circular annular flange 100*a* of the nozzle element in place within the circular opening 101. As viewed in FIG. 8P, the arcuate shaped, overhanging rib 96*b* is continuous for approximately 150.degree. around the top of an arc concentric of the longitudinal axis of the body 92. The rib is sharply discontinued at stop surfaces 103 so that the flange 100*a* of a nozzle element may be slipped into place from the exposed side of the tub wall 26 under the overhanging rib without requiring removal of the retaining ring 96. Once the nozzle element 100 is slipped into place with the flange 100*a* thereof seated for free rotation within the circular opening 101 of the ring 96, a second retainer 102 shaped to resemble a "C-ring" (FIG. 9P) is inserted into the lower portion of the opening 101 from the lower end portion thereof to overlie and retain the nozzle element 100 in place. The "C-ring" 102 is secured in place by a single fastener 104, the shank of which extends through an opening in a downwardly extending radial tab portion 102*a* of the "C-ring" adapted to fit between the lower ends of a pair of arcuate side ribs 96*c* which extend downwardly from the lower end stop surface 103 of the upper, overhanging rib 96*b*.

At the lower ends, the lower side ribs 96*c* terminate at stop faces 105 which are spaced apart slightly larger than the width of the downwardly extending tab 102*a* on the "C-ring" retainer 102. The flange of the nozzle body 92 is formed with a cylindrical boss 92*d* at the lower portion having an outwardly facing hollow bore 106 adapted to receive the shank of the single retaining fastener 104. The fastener shank 104 extends through an opening 26*e* in the tub wall and the opening is aligned with the bore 102 and the fastener is theadedly engaged in a ring hole 96*d* formed in the lower end portion of the annular retainer ring 96 to hold the C-ring in place. The "C-ring" retainer 102 includes a pair of arcuately curved upwardly extending side fingers 102*b* having curved inner surfaces 107 arranged to lie on cylindrical surface or circular portion slightly larger in diameter than the outer diameter of the adjustable nozzle element 100 at the inlet end.

Referring to FIG. 9P, at an intermediate level above stop surfaces 109, each finger 102*b* is reduced in width and includes a curved inner surface 11 lying on a cylindrical surface of a diameter slightly larger than the diameter of the lower finger portions as indicated by the numeral 107. Uppermost portions of the "C-ring" fingers 102*c* above a second pair of stop surfaces 113, have curved inner surfaces of the same diameter as the intermediate portions 102*b* but, are of a reduced thickness to slip under the overhanging rib 96*b* of the circular ring 96. The nozzle element 100 includes a rib 100*d* formed on the upper surface and the nozzle and rib is freely rotatable between the "C-ring" fingers 102*b* until the rib 100*d* engages either of the stop surfaces 109 at a lower level on a finger 102*b*.

The thin upper end 102*c* above the stop surface 113 of each finger permits the "C-ring" to be slipped into place to secure the nozzle element 100. The stop surfaces 113 are adapted to abut the stop surfaces 103 on the overhanging rib 96*b* of the annular retainer ring 96 when the "C-ring" retainer 102 is fully inserted upwardly into place. It should be noted that the outer surface of the overhanging rib portion 96*b* is on a plane substantially coextensive with the outer surface of the lower portion of the "C-ring" fingers 102*b* beneath the stop surfaces 113 so that when the "C-ring" is inserted into place and the tab 102*a* is secured to the ring 96 by a single fastener 104, the cooperating retainer ring 96 and "C-ring" 102 provide a neat appearance and a smooth annular face around the nozzle structure 100. Should a nozzle 100 become broken or clogged, the element may be readily removed for replacement, simply by loosening a single cap screw 104 and withdrawing the "C-ring" retainer 102 downwardly until the upper ends 102*c* of the finger are below the rib 96*b* of the retainer. When this is done, the nozzle element 100 can then be slipped out of the circular opening 101 in the annular retainer ring 96. The ring 96 is maintained continuously in place and does not have to be removed when replacing a nozzle element 100 or inserting a "C-ring" retainer 102. Both the ring 96 and "C-ring" 102 cooperate to support and retain the rotatable nozzle element 100 in place and the stop surfaces 109 provide positive limits of nozzle rotation. Access to the backside of the tub wall is not needed for replacement of a nozzle element and only a single fastener is required to secure the element and "C-ring" in place.

Referring now more particularly to FIGS. 4P, 5P, 5AP and 6P, the hydromassage apparatus 20 includes the manually operable air control valve 70 for selectively regulating the amount of air introduced into the flowing water through the air injectors 50. The control valve is adapted to be mounted in a convenient location, for example, on the horizontal tub flange 30 within convenient reach of a person sitting in the tub. The flange is formed with a circular opening 26*f*. The air control valve includes a body member 108 in coaxial alignment with the axis of the opening and preferably is formed of molded resinous plastic material. The body has a circular shaped, open upper end and a radial flange 108*a* extending outwardly thereof is sealed against the underside of the tub flange by sealing material 110 as illustrated.

The valve body is held in place by a pair of self-tapping fasteners 112 which extend downwardly through openings 26*g* drilled or punched in the tub flange at diametrically opposed positions outside of the large, centrally disposed circular opening 26*f*. At the lower end, the hollow body 108 is formed into a V-shaped trough structure 108*b* with a pair of outwardly extending nipple-like, outlet tubes 108*c* on opposite sides which are connected to the air conduit tubing 58 leading to the air inlet stems 82 on the respective air injectors 50. Similar to the stems 82, the outlet tubes 108*c* are formed with alternate rings of ridges and grooves to form an air tight interconnection with the tubing 58 attached thereto. Opposite sides of the lower end portion of the housing are formed with a pair of circular shaped outlet openings 108*d* to direct air flow out into the conduits 58 in communication with the outlet tubes.

Above the upper edges of the respective outlet openings 108*d*, there is provided a transverse stem or rib 108*e* that is integrally formed to extend between opposite sides of the body. The rib provides support for a spherically-shaped, water buoyant valve element or ball 114 which is loosely carried in the housing and adapted to move upwardly in response to a back flow of water that might come into the housing body from the tubes 58. The valve ball is adapted to provide a safety shut off for preventing any outflow or back up of water out of the top of the valve and is adapted to seat and close against a frustoconical valve surface 116 formed at the lower end of a hollow, tubular air inlet conduit 118 having a radial flange 118*a* integrally formed at the lower end and adapted to seat in a shoulder or groove 108*f* formed in the upper end of the body 108.

The flange 118*a* of the inlet conduit 118 is adhesively or otherwise sealed tightly to the surface of the groove 108*f*. The air inlet conduit 118 has a large circular bore between upper and lower ends to admit air flow into the valve body from the ambient atmosphere above the tub. In order to provide for selective control of the air flow between a fully closed or shut off condition and a fully open position for maximum flow rate, the upper edge of the conduit is formed with a contour or profile having a first or lower horizontal segment 119 extending around approximately one-quarter of the conduit circumference and immediately adjacent thereto, a maximum height or shut off segment 120 is provided having a horizontal upper surface spaced above the segment 119 and also occupying approximately one-quarter of the circumference of the inlet conduit. The segments 119 and 120 are interconnected by a helically sloped, graduated control segment 121, which covers the remaining 180.degree. of the circumference of the tubular conduit between the lower section 119 and the upper section 120.

The tubular inlet conduit 118 is formed with an annular groove 118*b* around the outer surface thereof and detachably seated within this groove is an inwardly extending annular rib 122*a* formed adjacent the lower edge of a generally cylindrical, skirt-like control element 122 depending downwardly from the underside of a rotatable cap 124 which provides for manual control of the air valve. The cap includes a frustoconically shaped, downwardly depending, outer skirt 126 having a cylindrical lower end portion 126*a* and this portion is spaced above the upper surface of the tub flange 30 to permit air to flow freely into the area around the control element 122 of the valve.

As best shown in FIG. 5P, an arcuate segment 128 of the depending skirt element 122 is cut away or absent from the complete circumference of the skirt and this provides a cooperative air inlet opening so that a selective control of the flow of air is attained by manipulating the rotative position of the cap with respect to the upper edge of the inlet conduit 118. Whenever the cap 124 is rotated to a position wherein the open 90. degree. segment 128 is in line or registration with the upstanding high level shut off segment 120 of the inlet conduit 118, all air flow is cut off. Manual rotation of the cap 124 from the shut off position results in a selectively controlled amount of open area for the ambient air to enter into the inlet conduit 118. When the segment 128 of the cap skirt 122 is moved into registration above the lowest segment 119 of the tubular conduit 118, a maximum airflow is provided and this is a fully open position. Intermediate positions between the closed or shut off position shown in FIG. 5 and the fully open position, results in a graduated amount of area being available for the inflow of ambient air and thus, the valve provides for positive control and convenient means for regulating air flow. The cap skirt 122 is flexible enough so that the cap may be removed entirely from the upstanding wall of the tubular inlet section 118 when desired and when in place above the tub flange 30, the cap provides a nice, neat appearing control element for the system.

Referring first to FIG. 1PP a whirlpool bath 1 has a tub 5 with a standard faucet and spicket assembly 6 and a standard tub drain 8. During whirlpool use the pump 2 circulates water via output pipe 4, air mixing pipe 10 and jets 11. Water is drawn from the filled tub via pump inlet pipe 3, which is connected, to the suction filter 9, the preferred embodiment. A switch 7 activates the pump 2.

Referring next to FIGS. 2PP, 3PP, 4PP the suction filter 9 is shown as seen by a bather in the tub in FIG. 2. The jets 11 are prior art. The only visible portion of the suction filter 9 is the faceplate 20. The faceplate 20 is preferably rectangular but could have any shape. The faceplate 20 has a peripheral mounting flange rim 29, which has receiving grooves 23,24 to slidingly engage L shaped brackets 25,26. The brackets 25,26 are molded into the mounting flange 30 of the filter housing 31.

The faceplate 20 has a raised convex center 27, which is perforated with a plurality of inlet holes 21 to allow the recirculating water to enter the filter housing 31. The rear of the faceplate 20 has support ribs 22 to strengthen the center 27 to prevent crushing. Hair entrapment is prevented typically in a 1–1½ inch piping system flowing at about 50 gallons per minute with a hole pattern of about 25 holes per square inch at about 0.25 inches O.D.

The prior art incorporated herein and as shown and described, and their particular configurations, are shown and described by way of example without limitation, as they relate to embodiments of the present invention.

Although certain embodiments of the present invention has been described with reference to disclosed embodiments, numerous modifications and variations can be made and still the result will come within the scope of the invention. No limitation with respect to the specific embodiments disclosed herein is intended or should be inferred.

We claim:

1. A method of making a fill and drain whirlpool bathtub having a tub, a closed loop plumbing system, an inlet pipe, an outlet pipe, a wall fitting and a water pump, the method comprising the steps of:

providing the tub having a sloped sidewall;

providing the inlet pipe made of a material having an antimicrobial therein;

providing the outlet pipe made of a material having an antimicrobial therein;

providing the wall fitting made of a material having an antimicrobial therein;

providing the water pump made of a material having an antimicrobial therein;

securing the wall fitting to the tub;

connecting the tub, the inlet pipe, the outlet pipe, the wall fitting, and the water pump to form the closed loop plumbing system for water flow;

configuring the inlet pipe to slope downward from the water pump to the wall fitting; and wherein the antimicrobial is of sufficient concentration and type to provide for bacteria reduction in the closed loop plumbing system where the bacteria contacts the antimicrobial, after tub drain down and between electrical system activation.

2. The method of claim 1, wherein the whirlpool bathtub is configured to retain less than 10 ½ ounces of water after tub drain down.

3. The method of claim 1, wherein the whirlpool bathtub is configured to retain less than 6 ½ ounces of water after tub drain down.

4. The method of claim 1, wherein the whirlpool bathtub is configured to retain less than 4 ounces of water after tub drain down.

5. The method of claim 1, wherein the tub surface is made of a material having an antimicrobial therein.

6. The method of claim 1, wherein the antimicrobial provides for optimum protection from bacteria.

7. A fill and drain whirlpool bathtub comprising: a tub having a sloped sidewall; an inlet pipe made of a material having an antimicrobial therein; an outlet pipe made of a material having an antimicrobial therein; a suction fitting made of a material having an antimicrobial therein; water jets wherein at least one of the water jets is made of a material having an antimicrobial therein; a water pump made of a material having an antimicrobial therein; the suction fitting having a faceplate housing portion, a faceplate, and an elbow housing portion; the faceplate housing portion having an input orifice, and a flange to provide a mount to a tub wall and a threaded portion that extends from behind the flange through an opening in the tub wall; wherein the faceplate housing portion comprises a sloped interior wall; the elbow housing portion having a sloped interior wall and an output orifice extending substantially perpendicular to the input orifice of the faceplate housing portion; wherein the output orifice is connected to a pipe of a closed loop piping system at a slanted angle so as to allow water in the piping system to drain out into the tub when the tub is being drained of water; wherein the sloped interior wall of the elbow housing portion, the slanted angle and the sloped interior wall of the faceplate housing portion define a sloped interior surface that slopes downward from the output orifice to the input orifice so as to allow water in the piping system to efficiently drain out through the elbow housing portion and the faceplate housing portion into the tub; the faceplate having a plurality of water flow through passages in the lower portion; the suction fitting attached to the tub; wherein the tub, the suction fitting, the outlet pipe, the water jets, and the water pump form the closed loop piping system for water flow; and wherein the antimicrobial is of sufficient concentration and type to provide for bacteria reduction in the closed loop plumbing system where the bacteria contacts the antimicrobial, after tub drain down and between electrical system activation.

8. A fill and drain whirlpool bathtub comprising: a tub having a sloped sidewall; an inlet pipe made of a material having an antimicrobial therein; an outlet pipe made of a material having an antimicrobial therein; a suction fitting made of a material having an antimicrobial therein, the suction fitting having an elbow fitting; water jets wherein at least one of the water jets is made of a material having an antimicrobial therein; a water pump made of a material having an antimicrobial therein; an air port having a portion that extends outward from the elbow fitting and the portion perpendicular to an input orifice of the suction fitting; wherein the suction fitting is attached to the tub and the inlet pipe is attached to the suction fitting; wherein the tub, the suction fitting, the outlet pipe, the water jets, and the water pump form a closed loop plumbing system for water flow; and wherein the antimicrobial is of sufficient concentration and type to provide for bacteria reduction in the closed loop plumbing system where the bacteria contacts the antimicrobial, after tub drain down and between electrical system activation.

* * * * *